US007358931B2

(12) United States Patent
Mizobata et al.

(10) Patent No.: US 7,358,931 B2
(45) **Date of Patent: *Apr. 15, 2008**

(54) PLASMA DISPLAY DEVICE AND METHOD FOR DRIVING THE SAME

(75) Inventors: Eishi Mizobata, Tokyo (JP); Tadashi Nakamura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 648 days.

This patent is subject to a terminal disclaimer.

(21) Appl. No.: 10/927,390

(22) Filed: Aug. 27, 2004

(65) Prior Publication Data

US 2005/0068262 A1 Mar. 31, 2005

(30) Foreign Application Priority Data

Aug. 29, 2003 (JP) ..... 2003-307915

(51) Int. Cl.
*G09G 3/28* (2006.01)

(52) U.S. Cl. ..... 345/60; 345/62; 345/63; 345/66; 345/67; 345/68

(58) Field of Classification Search ..... 345/60–69, 345/71–83, 204–215; 315/169.1–169.4
See application file for complete search history.

(56) References Cited

U.S. PATENT DOCUMENTS 6,717,557 B2 * 4/2004 Ishizuka ..... 345/60
6,954,187 B2 * 10/2005 Mizobata et al. ..... 345/60
7,012,580 B2 * 3/2006 Mizobata ..... 345/60

FOREIGN PATENT DOCUMENTS

JP 9-6283 A 1/1997
JP 2002-207449 A 7/2000

* cited by examiner

*Primary Examiner*—Vijay Shankar
(74) *Attorney, Agent, or Firm*—Sughrue Mion, PLLC

(57) ABSTRACT

A plasma display device is provided which is capable of expanding an ensured operating temperature range or operating life time even at time of changes of a driving margin induced by a panel temperature or cumulative operating time of the panel. Display is controlled in a scanning period during which writing discharge is made to occur in a cell, in a sustaining period during which a cell having undergone writing discharge is turned ON for displaying, and in an initializing period during which wall charges in a cell and space charges accumulated before the scanning period starts are initialized. A wall charge adjusting period during which a potential difference between scanning electrodes and data electrodes varies gradually is set and a change rate of a potential between scanning electrodes and data electrodes during the wall charge adjusting period is changed according to the panel temperature and/or cumulative operating time of the panel.

32 Claims, 19 Drawing Sheets when panel temperature is lower than set temperature when panel temperature is higher than set temperature

FIG.9A

| SF name | | 1SF | 2SF | 3SF | 4SF | 5SF | 6SF | 7SF | 8SF |
|---|---|---|---|---|---|---|---|---|---|
| ratio of number of sustaining pulses | | 1 | 2 | 4 | 8 | 16 | 32 | 64 | 128 |
| tpe | in the case of temperature<Tth | tpe1 | tpe1 | tpe1 | tpe1 | tpe1 | tpe1 | tpe1 | tpe1 |
| | in the case of temperature≧Tth | tpe1 | tpe1 | tpe1 | tpe1 | tpe2 | tpe2 | tpe2 | tpe2 |
| scanning pulse width | in the case of temperature<Tth | large | large | large | large | large | large | large | large |
| | in the case of temperature≧Tth | large | large | large | large | large | large | large | large |

FIG.9B

| SF name | | 1SF | 2SF | 3SF | 4SF | 5SF | 6SF | 7SF | 8SF |
|---|---|---|---|---|---|---|---|---|---|
| ratio of number of sustaining pulses | | 1 | 2 | 4 | 8 | 16 | 32 | 64 | 128 |
| tpe | in the case of temperature<Tth | tpe1 | tpe1 | tpe1 | tpe1 | tpe1 | tpe1 | tpe1 | tpe1 |
| | in the case of temperature≧Tth | tpe1 | tpe1 | tpe2 | tpe2 | tpe2 | tpe2 | tpe2 | tpe2 |
| scanning pulse width | in the case of temperature<Tth | large | large | large | large | large | large | large | large |
| | in the case of temperature≧Tth | small | small | small | small | small | small | small | small |

FIG.9C

| SF name | | 1SF | 2SF | 3SF | 4SF | 5SF | 6SF | 7SF | 8SF |
|---|---|---|---|---|---|---|---|---|---|
| ratio of number of sustaining pulses | | 1 | 2 | 4 | 8 | 16 | 32 | 64 | 128 |
| tpe | in the case of temperature<Tth1 | tpe3 | tpe3 | tpe3 | tpe3 | tpe3 | tpe3 | tpe3 | tpe3 |
| | in the case of Tth1≦temperature<Tth2 | tpe3 | tpe3 | tpe4 | tpe4 | tpe4 | tpe4 | tpe4 | tpe4 |
| | in the case of temperature≧Tth2 | tpe3 | tpe3 | tpe4 | tpe4 | tpe5 | tpe5 | tpe5 | tpe5 |
| scanning pulse width | in the case of temperature<Tth1 | large | large | large | large | large | large | large | large |
| | in the case of Tth1≦temperature<Tth2 | large | large | large | large | large | large | large | large |
| | in the case of temperature≧Tth2 | large | large | large | large | large | large | large | large |

*when number of sustaining pulses is smaller than preset number of sustaining pulses*

*when number of sustaining pulses is larger or equal to preset number of sustaining pulses*

PLASMA DISPLAY DEVICE AND METHOD FOR DRIVING THE SAME

BACKGROUND OF THE INVENTION

1. Field of the Invention

The present invention relates to a plasma display device having a three-electrode AC (Alternating Current) type of plasma display panel and a method for driving the plasma display device.

The present application claims priority of Japanese Patent Application No. 2003-307915 filed on Aug. 29, 2003, which is hereby incorporated by reference.

2. Description of the Related Art

A plasma display panel (hereinafter may be referred to simply as a "PDP") has, in general, many advantages in that it can be made thin, display on a large screen is made possible with comparative ease, it can provide a wide viewing angle, it can give a quick response, and a like. Therefore, in recent years, the PDP is being widely and increasingly used, as a flat display panel, for wall-hung TVs, public information boards, or a like. The PDP is classified, depending on its operating method, into two types, one being a DC (Direct Current) discharge-type PDP whose electrodes are exposed in a discharge space (discharge gas) and which is operated in a direct-current discharge state and another being an AC (Alternating Current) discharge-type PDP whose electrodes are coated with a dielectric layer and are not exposed directly in a discharge gas and which is operated in an alternating-current discharge state. In the DC-type PDP, while a voltage is being applied, discharge continues to occur. In the AC-type PDP, discharge is sustained by reversing a polarity of a voltage to be applied. The AC-type PDP is also classified, depending on the number of electrodes in one cell, into two types, one being a two-electrode type AC-type PDP and another being a three-electrode AC-type PDP.

Configurations and driving method of the conventional three-electrode AC-type PDP are described below. FIG. 17 is a cross-sectional view illustrating configurations of one cell in the conventional three-electrode AC-type PDP. FIG. 18 is a plan view illustrating configurations of the conventional three-electrode AC-type PDP. FIG. 19 is a diagram showing driving waveforms of pulses to be applied in the conventional three-electrode AC-type PDP.

The conventional three-electrode AC-type PDP, as shown in FIG. 17, has a front substrate 20 and a rear substrate 21, both facing each other, two or more scanning electrodes 22, two or more sustaining electrodes 23, and two or more data electrodes 29, all being placed between the front substrate 20 and the rear substrate 21, and display cells being arranged in a matrix form and each being placed in a portion of intersection among each of the scanning electrodes 22, each of the sustaining electrodes 23, and each of the data electrodes 29.

The front substrate 20 is made up of a glass substrate or a like, on which each of the scanning electrodes 22 and each of the sustaining electrodes 23 is placed at a specified interval between them. On each of the scanning electrodes 22 and sustaining electrode 23 is formed a metal trace electrode 32 to lower wiring resistance. On the scanning electrodes 22, sustaining electrodes 23, and metal trace electrodes 32 is formed a transparent dielectric layer 24 and, further, in order to protect the transparent dielectric layer 24 from discharge, a protecting layer 25 made of magnesium oxide (MgO) or a like is formed on the transparent dielectric layer 24. The rear substrate 21 is made up of a glass substrate, or a like, on which each of the data electrodes 29 is formed in a manner to be orthogonal to each of the scanning electrodes 22 and sustaining electrodes 23. On the data electrodes 29 are formed a white dielectric layer 28 and a phosphor layer 27. Between the front substrate 20 and rear substrate 21 are formed parallel-cross shaped ribs 33 in a manner to surround each cell. Each of the ribs 33 plays a role of securing a discharge space 26 and of partitioning pixels. Each discharge space 26 is filled with a mixed gas made of, as discharge gas, helium (He), neon (Ne), xenon (Xe) or a like in a hermetically sealed manner.

In the conventional three-electrode AC-type PDP, as shown in FIG. 18, display cells are arranged in a matrix form, each being formed in a portion of intersection among each electrode Si (i=1 to m) making up the scanning electrode 22, each electrode Ci (i=1 to m) making up the sustaining electrode 23, and each electrode Dj (j=1 to n) making up the data electrode 29.

Next, a method for driving a PDP is described. Presently, the method for driving the PDP being in a mainstream is an ADS (Address and Display Separation) method in which operations are performed in its scanning period and sustaining period in a separated manner. The ADS method is explained by referring to FIG. 19. FIG. 19 shows one example of driving waveforms of pulses applied during one sub-field (called simply as an "SF" in drawings) 5 employed in the conventional three-electrode AC-type PDP. One sub-field 5 includes three periods including an initializing period 2, a scanning period 3 and a sustaining period 4.

First, operations in the initializing period 2 are described. As shown in FIG. 19, before the initializing period 2, a sustaining period 1 in a previous sub-field exists and an amount of wall charges to be formed, which are charges accumulated by discharge on a dielectric layer on each electrode in a cell, varies depending on whether or not sustaining discharge has occurred during the sustaining period 1 in the previous sub-field. If writing on a following line is done in a state in which wall charges formed by the discharge occurred during the sustaining period 1 in the previous sub-field are still left, due to influences caused by the left wall charges being different depending on a lighting state of a cell in the sustaining period 1, occurrence of smooth writing discharge is made difficult, thus causing erroneous writing. One of roles of operations to be performed during the initializing period 2 in the sub-field 5 is to reset, for initialization, a state of accumulated wall charges which vary depending on a lighting state of a cell during the sustaining period 1 in the previous sub-field and which are charges formed by discharge on a dielectric layer in the cell.

The setting for initialization is made mainly during a sustaining erasing period 8 in the initializing period 2, as shown in FIG. 19. During the sustaining erasing period 8, only when sustaining discharge occurs during the sustaining period 1 in the previous sub-field, feeble discharge occurs between each of the scanning electrodes 22 and sustaining electrodes 23 and between each of the scanning electrodes 22 and data electrodes 29. Unlike in the case of intense discharge that occurs at a dash by application of a pulse having a rectangular waveform which reverses, at a stroke, a polarity of a wall charge formed on the electrodes, feeble discharge occurs in a sustained manner by a gradual change in a voltage at each of the scanning electrodes 22 according to a ramp waveform of an applied pulse during the sustaining erasing period 8, which produces a little change in wall charges formed on the electrode by discharge.

On the other hand, operations during the initializing period 2 have additional roles of providing a priming effect by which discharge is made easy when data is written in a one-pass scanning manner according to data to be displayed and of putting a state of wall charges into a state in which writing discharge occurs in an optimized manner. These roles are realized mainly during a priming period 9 and during a wall charge adjusting period 10. During the priming period 9, feeble discharge occurs regardless of whether or not sustaining discharge occurred during the sustaining period 1 in the previous sub-field and this discharge causes priming particles in cell space which serves to induce a state in which writing discharge is likely to occur easily. Moreover, during the priming period 9, a potential of each of the scanning electrodes 22 increases gradually in a manner to have positive polarity relative to a potential of each of the data electrodes 29 and, as a result, negative wall charges increase on each of the scanning electrodes 22 and positive wall charges increase on each of the data electrodes 29. Production of priming particles and increases in wall charges as described above serve to cause writing discharge to occur easily and, in the case in which a cell has continued to be not lit for a long time in particular, since priming particles and wall charges tend to decrease, the above production of priming particles and the increases in wall charges work to compensate for these decreases.

In the wall charge adjusting period 10, amounts of wall charges formed on each of the electrodes during the priming period 9 are adjusted so that a display panel can operate in a proper manner. Also, in the wall charge adjusting period 10, as in the case of the initializing period 2, feeble discharge occurs between each of the scanning electrodes 22 and each of the sustaining electrodes 23 and between each of the scanning electrodes 22 and each of the data electrodes 29. Moreover, in the wall charge adjusting period 10, since a data electrode potential is fixed to be at a ground potential and a scanning electrode potential lowers gradually according to the ramp waveform of a pulse, the ultimate potential of the scanning electrode potential becomes almost the equal to a potential of a scanning pulse 6. In a final stage of the feeble discharge, the potential between each of the scanning electrodes 22 and each of the data electrodes 29 is put in a state in which amounts of the wall charges are changed by discharge to a level at which discharge is likely not to occur until immediately before an end of the scanning period 3. That is, in the wall charge adjusting period 10, between each of the scanning electrodes 22 and each of the data electrodes 29, a state occurs in which wall charges are reduced to a level at which discharge does not occur unless a data pulse 7 is applied at the same time when the scanning pulse 6 is applied.

On the other hand, wall charges are in a state in which, if a positive pulse is applied even a little to each of the data electrodes 29, discharge occurs and, therefore, writing discharge occurs at a low data pulse voltage. However, since time is required before discharge occurs after application of a voltage in actual operations, in order for discharge to occur during a period for which such a pulse having a short wavelength as the scanning pulse 6 is being applied, some data pulse voltage is needed. In the initializing period 2, as described above, a cell state being optimized to resetting for initialization of wall charges and to occurrence of writing discharge is realized.

Next, operations during the scanning period 3 are explained. The scanning period 3 is a period during which a state of wall charges is sequentially changed for each of the scanning electrodes 22 according to video signals in a manner to correspond to occurrence or non-occurrence of writing discharge to write video information into a cell. During the scanning period 3, a scanning pulse 6 is applied sequentially to each electrode (S1 to Sm) making up the scanning electrode 22. With timing with which the scanning pulse 6 is applied, a data pulse 7 is applied, in a manner to correspond to a display pattern, to each electrode (D1 to Dn) making up the data electrode 29. A sloped line in the data pulse 7 in FIG. 19 represents that the data pulse 7 is applied or not applied according to video signals.

Occurrence or non-occurrence of writing discharge is determined in a way described below. While the data pulse 7 is being applied, a potential between each of the scanning electrodes 22 and each of the data electrodes 29 is a potential difference "Vd". At this time point, as described above, a negative charge is formed on each of the scanning electrodes 22 and a positive charge is formed on each of the data electrodes 29. Since voltages of wall charges applied to a dielectric layer by these wall charges are superimposed on the potential difference between each of the scanning electrodes 22 and each of the data electrodes 29, a high voltage is generated in the discharge space 26 between each of the scanning electrodes 22 and each of the data electrodes 29 and, as a result, writing discharge occurs between each of the scanning electrodes 22 and each of the data electrodes 29. At this time point, since a big potential difference between each of the scanning electrodes 22 and each of the sustaining electrodes 23 is also produced, when the writing discharge occurs between each of the scanning electrodes 22 and each of the data electrodes 29, surface discharge is induced between each of the scanning electrodes 22 and sustaining electrodes 23 and, therefore, positive wall charges are accumulated on each of the scanning electrodes 22 and negative wall charges are accumulated on each of the sustaining electrodes 23.

On the other hand, in cells to which no data pulse 7 is fed, since a difference of a potential to be applied in the discharge space 26 between each of the scanning electrodes 22 and each of the data electrodes 29 does not exceed a discharge starting voltage, no discharge occurs and the state of wall charges remain unchanged. Thus, two types of states of wall charges can be obtained depending on whether the data pulse 7 is applied or not.

After the application of the scanning pulse 6 has been completed to all lines, operations in the sustaining period 4 start. A sustaining pulse is alternately applied to all the scanning electrodes 22 and all the sustaining electrodes 23. Since a voltage "Vs" of the sustaining pulse is adjusted so as to be almost the same as a wall voltage occurring in the vicinity of a discharge gap 34 between each of the scanning electrodes 22 and each of the sustaining electrodes 23 in cells in which writing discharge did not occur, only the voltage "Vs" being a potential difference between a voltage at each of the scanning electrodes 22 and a voltage at each of the sustaining electrodes 23 is applied in the discharge gap 34 between each of the scanning electrodes 22 and each of the sustaining electrodes 23 and, therefore, discharge (the discharge occurring between each of the scanning electrodes 22 and each of the sustaining electrodes 23 is called a "surface discharge") does not occur between each of the scanning electrodes 22 and each of the sustaining electrodes 23.

On the other hand, in cells in which writing discharge has occurred, since a positive wall charge is formed on each of the scanning electrodes 22 and a negative wall charge is formed on each of the sustaining electrodes 23 and since the positive and negative wall charges are superimposed on a first voltage of the positive sustaining pulse (called as a "first sustaining pulse") to be applied to each of the scanning electrodes 22 and, since a voltage exceeding a discharge starting voltage is applied in the discharge gap 34, sustaining discharge occurs. This sustaining discharge causes negative wall charges to be accumulated on each of the scanning electrodes 22 and positive wall charges to be accumulated on each of the sustaining electrodes 22.

A next sustaining pulse (called a "second sustaining pulse") is applied to each of the sustaining electrodes 23 and wall charges described above are superimposed on a voltage of the second sustaining pulse and, therefore, also sustaining discharge occurs here, thus causing wall charges having a polarity being reverse to that of the first sustaining pulse to be accumulated on both each of the scanning electrodes 22 and each of the sustaining electrodes 23. Thereafter, discharge occurs by the same operations as above in a sustained manner. That is, a potential produced by wall charges formed by "x-th" time sustaining discharge is superimposed on a voltage of a next "x+1st" time sustaining pulse and the sustaining discharge continues to occur. Light-emitting luminance is determined by the times of sustaining occurrences of this sustaining discharge.

A total period including the initializing period 2, scanning period 3, and sustaining period 4 described above is called a "sub-field" (SF)". When a gray scale is displayed by a display device, one field during which one screen of image information is displayed includes two or more sub-fields. The gray-scale display can be realized by changing the number of the sustaining pulses during each sub-field to cause lighting or non-lighting of a cell during each of the sub-fields.

In the method for driving the conventional AC-type PDP, even if a pulse having the same driving waveform is applied, since intense and/or expansion, or a like of discharge are changed according to a change in a state of a cell in the PDP, an amount of wall charges to be formed in a cell and/or an amount of space charges vary. In particular, if an amount of wall charges and/or an amount of space charges are changed in the initializing period, a writing discharge state during the scanning period thereafter varies which, therefore, causes erroneous non-lighting or erroneous lighting. Such the change of a state in the cell occurs mainly in a manner to correspond to a temperature of a panel or a total driving time during which the panel was operated until then.

As a measure against a writing discharge failure caused by such the change of a state in the cell, a driving method is disclosed in Japanese Patent Application Laid-open No. Hei 9-6283 ([0210] to [0220]) in which a driving waveform is switched in a manner to correspond to a panel temperature. In the sixth embodiment of the above disclosed example, a counter measure against the writing discharge failure caused by the panel temperature is taken by switching the driving waveform during the initializing period (this is called a "reset period" in the example) in a manner to correspond to the panel temperature.

In addition to this, as a measure to perform a more reliable initializing process while operations are performed at a high temperature of a panel, another driving method is disclosed in Japanese Patent Application No. 2002-207449 ([0022]) in which an initializing period (this is called a "blank period+reset period" in the disclosed example) is made longer while operations are performed at a high panel temperature and in which it is described that, by making long the blank period making up the initializing period, space charges decrease, thus enabling occurrence of erroneous discharge to be avoided.

In the case of the above-described conventional method by which a measure against a writing discharge failure caused by panel temperatures by switching a driving waveform during the initializing period in a manner to correspond to the panel temperatures, driving during the initializing period is performed by self-erasing discharge using a rectangular waveform and not using a ramp waveform as shown in FIG. 19. The self-erasing discharge is intense discharge and, if the initializing operation is performed by such the discharge, wall charges cannot be controlled in a delicate manner. This presents a problem in that optimized initialization by using the conventional method becomes difficult.

Also, in the conventional method by which, by making the operating time longer during the initializing period at a high panel temperature and by making longer the blank period making up the initializing period in particular, space charges are made to be decreased to avoid the occurrence of erroneous discharge, however, this method presents a problem in that, to avoid erroneous discharge, the control on space charge is insufficient and wall charges have to be controlled according to a change of a state of a cell.

SUMMARY OF THE INVENTION

In view of the above, it is an object of the present invention to provide a plasma display device which is capable of avoiding erroneous operations and of performing stable operations by properly controlling wall charges in cells according to a change of a state in each of the cells and a method for driving the plasma display device being capable of achieving the above.

According to a first aspect of the present invention, there is provided a plasma display device including a panel which includes:

a first substrate on which two or more pairs of electrodes are formed, each pair being made up of a scanning electrode and a sustaining electrode, both being parallel to each other; and a second substrate on which two or more data electrodes are formed in a manner in which each of the data electrodes and each pair of electrodes intersect each other;

wherein display operations are controlled in a scanning period during which a writing discharge is made to occur according to video signals, in a sustaining period during which a cell having undergone the writing discharge is turned ON, and in an initializing period being set before the scanning period, during which wall charges and space charges accumulated in the cell before the scanning period starts are initialized; and wherein the initializing period has, in its final portion, a wall charge adjusting period during which a potential difference between the scanning electrode and the data electrode changes gradually and a change rate of the potential difference is controlled according to a panel temperature and/or cumulative operating time of the panel.

According to a second aspect of the present invention, there is provided a plasma display device including a panel which includes:

a first substrate on which two or more pairs of electrodes are formed, each pair being made up of a scanning electrode and a sustaining electrode, both being parallel to each other; and a second substrate on which two or more data electrodes are formed in a manner in which each of said data electrodes and each pair of electrodes intersect each other;

wherein display operations are controlled in a scanning period during which a writing discharge is made to occur according to video signals, in a sustaining period during which a cell having undergone said writing discharge is turned ON, and in an initializing period being set before said scanning period, during which wall charges and space charges accumulated in said cell before said scanning period starts are initialized, in each of two or more sub-fields obtained by dividing one field, each of which comprises said scanning period, said sustaining period and said initializing period; and wherein, in at least one sub-field out of said two or more sub-fields making up one field, said initializing period has, in its final portion, a wall charge adjusting period during which a potential difference between said scanning electrode and said data electrode changes gradually and a change rate of said potential difference is controlled according to a panel temperature and/or cumulative operating time of said panel.

In the foregoing, a preferable mode is one wherein said sub-field during which a change rate of said potential difference is controlled according to said panel temperature and/or cumulative operating time of said panel is a sub-field, during which the largest number of sustaining pulses exists, out of said two or more sub-fields making up one field, or N ("N" denotes an integer being smaller than the number of sub-fields in one field)-pieces of sub-fields being set in decreasing order of number of sustaining pulses.

According to a third aspect of the present invention, there is provided a method for driving a plasma display device including a panel which includes a first substrate on which two or more pairs of electrodes are formed, each pair being made up of a scanning electrode and a sustaining electrode, both being parallel to each other and a second substrate on which two or more data electrodes are formed in a manner in which each of the data electrodes and each pair of electrodes intersect each other, the method including:

a step of controlling display operations in a scanning period during which a scanning pulse is sequentially applied to the scanning electrode to cause a writing discharge to occur according to video signals, in a sustaining period during which a cell having undergone the writing discharge is turned ON, and in an initializing period being set before the scanning period, during which wall charges and space charges accumulated in the cell before the scanning period starts are initialized; and a step of changing a change rate of a potential difference between the scanning electrode and the data electrode according to a panel temperature and/or cumulative operating time of the panel during a wall charge adjusting period existing in a final portion of the initializing period during which the potential difference between the scanning electrode and the data electrode changes gradually.

According to a fourth aspect of the present invention, there is provided a method for driving a plasma display device including a panel which includes a first substrate on which two or more pairs of electrodes are formed, each pair being made up of a scanning electrode and a sustaining electrode, both being parallel to each other and a second substrate on which two or more data electrodes are formed in a manner in which each of the data electrodes and each pair of electrodes intersect each other, the method including:

a step of controlling display operations in a scanning period during which a scanning pulse is sequentially applied to the scanning electrode to cause writing discharge to occur according to a video signal in each of sub-fields obtained by dividing one field displaying one video signal into two or more sub-fields, in a sustaining period during which a cell having undergone the writing discharge is turned ON in each of the sub-fields, and in an initializing period being set before the scanning period during which wall charges and space charges accumulated in the cell before the scanning period starts are initialized in each of the sub-fields; and a step of changing, in at least one sub-field out of the two or more sub-fields making up the one field, a change rate of a potential difference between the scanning electrode and the data electrode according to the panel temperature and/or cumulative operating time of the panel during a wall charge adjusting period existing in a final portion of the initializing period, during which the potential difference between the scanning electrode and the data electrode changes gradually.

In the third or fourth aspect, a preferable mode is one wherein a sub-field having the wall charge adjusting period during which a change rate of a potential difference between the scanning electrode and the data electrode is changed is so configured to exist on a side of a sub-field during which a number of sustaining pulses to be applied in the sustaining period is larger.

Also, a preferable mode is one wherein the number of sub-fields during which a change rate of a potential difference between the scanning electrode and the data electrode in the wall charge adjusting period is changed is changed according to the number of sustaining pulses in the one field.

Also, a preferable mode is one wherein, when the number of sustaining pulses in the one field is the larger, the number of sub-fields during which a change rate of a potential difference between the scanning electrode and the data electrode in the wall charge adjusting period is changed is made the smaller.

Also, a preferable mode is one wherein a pulse width of the scanning pulse is changed according to the number of sub-fields during which a change rate of a potential difference between the scanning electrode and data electrode in the wall charge adjusting period is changed.

Also, a preferable mode is one, wherein, when the number of sub-fields during which a change rate of a potential difference between the scanning electrode and the data electrode in the wall charge adjusting period is changed is the larger, the pulse width of the scanning pulse is made the smaller.

Also, a preferable mode is one wherein, when the higher the panel temperature is, the more a change rate of a potential difference between the scanning electrode and the data electrode in the wall charge adjusting period decreases.

Also, a preferable mode is one, wherein, the longer cumulative operating time of the panel is, a change rate of a potential difference between the scanning electrode and the data electrode in the wall charge adjusting period is made the larger.

Also, a preferable mode is one, wherein, irrespective of variations in a change rate of a potential difference between the scanning electrode and the data electrode in the wall charge adjusting period, a final ultimate potential difference between the scanning electrode and the data electrode in the wall charge adjusting period is not changed.

Also, a preferable mode is one, wherein a length of the wall charge adjusting period is changed according to a change rate of a potential difference between the scanning electrode and the data electrode in the wall charge adjusting period.

Also, a preferable mode is one, wherein, after a period during which a potential difference between the scanning electrode and the data electrode changes, a holding period during which the potential difference becomes constant is set and wherein, irrespective of variations in a change rate of a potential difference between the scanning electrode and the data electrode in the wall charge adjusting period, the holding period is not changed.

Also, a preferable mode is one, wherein, according to the number of sustaining pulses in the sustaining period, a change rate of a potential difference between the scanning electrode and the data electrode in the wall charge adjusting period is changed.

Also, a preferable mode is one, wherein a change rate of a potential difference between the scanning electrode and the data electrode in the wall charge adjusting period is changed according to at least one threshold value in the temperature and/or cumulative operating time of the panel so that the change rate of the potential difference becomes a predetermined change rate.

Also, a preferable mode is one wherein the pulse width of the scanning pulse is changed according to a change rate of a potential difference between the scanning electrode and the data electrode in the wall charge adjusting period.

Furthermore, a preferable mode is one wherein, when a change rate of a potential difference between the scanning electrode and the data electrode in the wall charge adjusting period is the smaller, the pulse width of the scanning pulse is made the smaller.

With the above configuration, a change rate of a potential difference between the scanning electrode and the data electrode is changed according to the panel temperature and/or cumulative operating time of the panel and, therefore, in the case of the plasma display device having the PDP whose operating margin is changed by the panel temperature, its ensured temperature range can be expanded and, in the case of the plasma display device having the PDP whose operating margin is changed by total operating time of the panel, its operating life time can be extended.

BRIEF DESCRIPTION OF THE DRAWINGS

The above and other objects, advantages, and features of the present invention will be more apparent from the following description taken in conjunction with the accompanying drawings in which:

FIGS. 9A to 9C are diagrams showing time in periods during which voltages change in wall charge adjusting periods in sub-fields employed in a PDP of sixth to eighth embodiments of the present invention;

DETAILED DESCRIPTION OF THE PREFERRED EMBODIMENTS

Figure 1A:
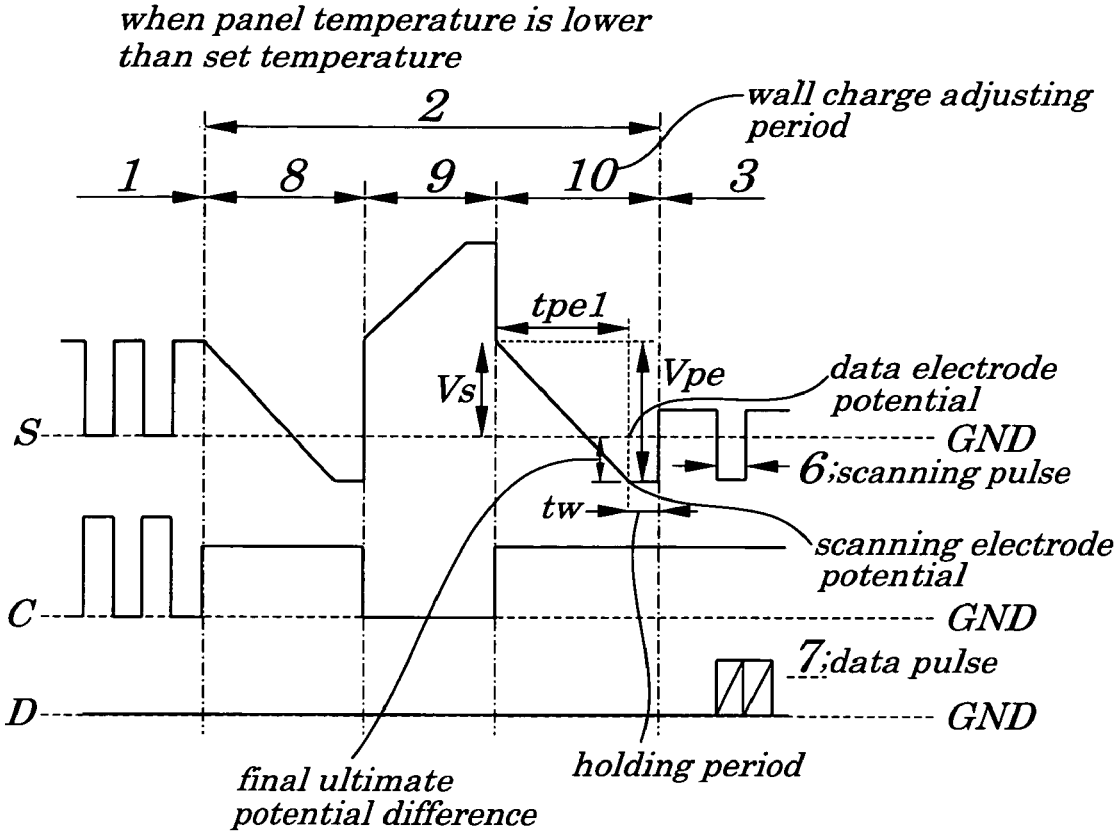
FIGS. 1A and 1B are diagrams showing driving waveforms of pulses applied immediately before, after, and during an initializing period in a PDP used in a plasma display device of a first embodiment of the present invention.

Best modes of carrying out the present invention will be described in further detail using various embodiments with reference to the accompanying drawings.

With the configurations of the present invention, to drive an AC-type PDP, before a scanning period, a wall charge adjusting period during which a potential difference between each of scanning electrodes and each of data electrodes changes gradually is set in a last portion of an initializing period during which wall charges and space charge in a cell already existing before the wall charge adjusting period are initialized and, during the wall charge adjusting period, a change rate of the potential difference between each of scanning electrodes and each of data electrodes is controlled according to a panel temperature and/or cumulative operating time of the panel. Such control on the change rate as described above is made to be exercised during at least one sub-field out of two or more sub-fields obtained by dividing one field during which one video is displayed. At this time point, the sub-field during which the change rate of the potential between each of the scanning electrodes and each of the data electrodes in the wall charge adjusting period is changed is preferably so configure to exist on a side of a sub-field during which the number of sustaining pulses to be applied in the sustaining period is larger.

It is also preferable that, when the number of sustaining pulses in one sub-field is the larger, the number of sub-fields is made the smaller in a period during which a change rate of a potential difference between each of the scanning electrodes and each of the data electrodes in the wall charge adjusting period is changed. Also, it is preferable that, when the number of sub-fields is the larger during which the change rate of the potential difference between each of the scanning electrodes and each of the data electrodes in the wall charge adjusting period is changed, a width of a scanning pulse is made the smaller. Also, it is preferable that, when the panel temperature is the higher than a set temperature, the change rate of the potential between each of the scanning electrodes and each of the data electrodes in the wall charge adjusting period is made the smaller.

It is also preferable that, when cumulative operating time of the panel is the longer, the change of a potential difference between each of the scanning electrodes and each of the data electrodes in the wall charge adjusting period is made the larger. Irrespective of variations in the change rate of the potential difference between each of the scanning electrodes and each of the data electrodes in the wall charge adjusting period, the final ultimate potential between each of the scanning electrodes and each of the data electrodes during the wall charge adjusting period is made unchanged not to increase a voltage set for a pulse having a driving waveform.

Also, a length of the wall charge adjusting period is preferably changed according to the change rate of the potential difference between each of the scanning electrodes and each of the data electrodes in the wall charge adjusting period. It is preferable that, after a period during which the change rate of the potential difference between each of the scanning electrodes and each of the data electrodes is changed, a holding period during which the potential difference is kept constant is set and, irrespective of variations in the change rate of a potential difference between each of the scanning electrodes and each of the data electrodes in the wall charge adjusting period, the holding period is not changed. Also, the change rate of a potential difference between each of the scanning electrodes and each of the data electrodes is preferably made varied according to the number of sustaining pulses during the sustaining period.

By changing the change rate of the potential difference between each of the scanning electrodes and each of the data electrodes in the wall charge adjusting period so that the change rate becomes a predetermined rate according to at least one threshold value out of panel temperature and/or cumulative operating time of the panel, reduction in size of a circuit to be used when a change rate of a voltage is made varied by analog processing is made possible. Furthermore, it is preferable that the change rate of the potential difference between each of the scanning electrodes and each of the data electrodes in the wall charge adjusting period is the smaller, a width of a scanning pulse is made the smaller.

First Embodiment

Figure 1B:
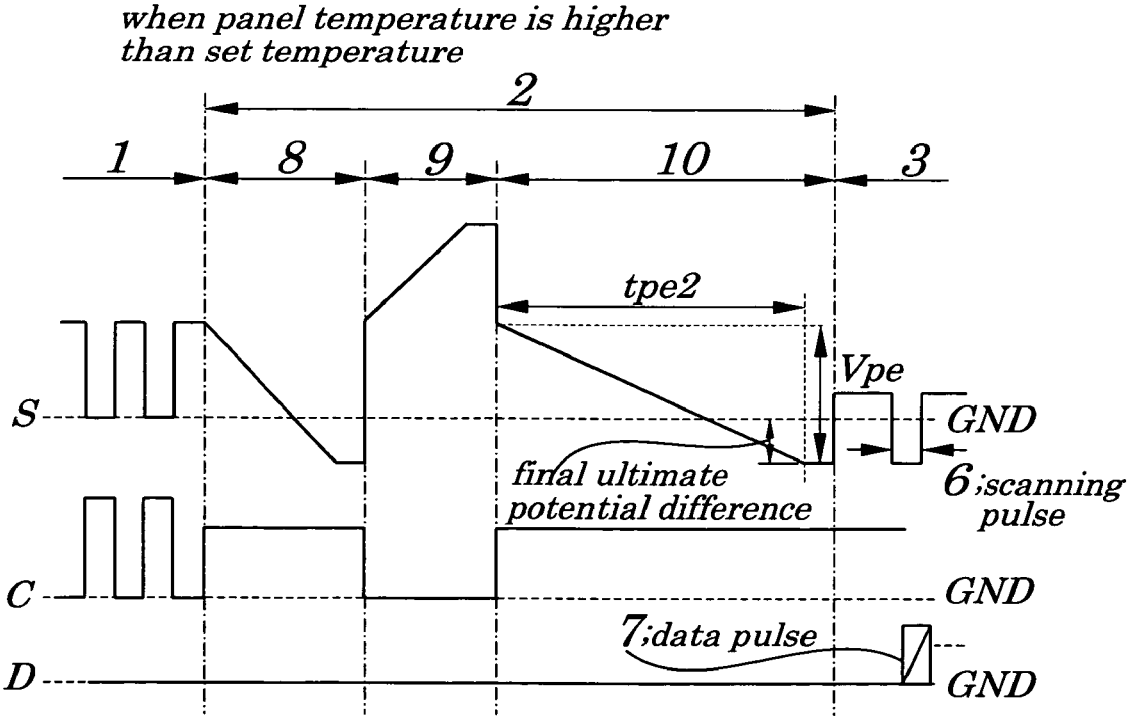
Figure 2A:
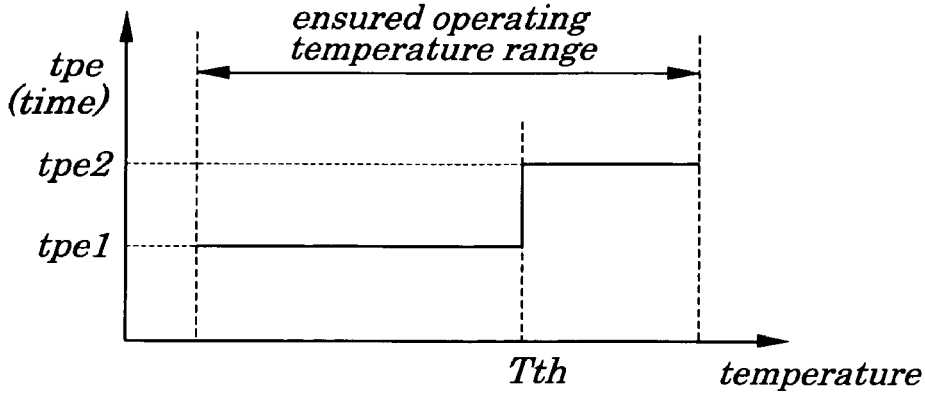
FIGS. 2A to 2D are diagrams showing relations between time and temperatures in periods during which voltages change in wall charge adjusting periods respectively in first, third, fourth, and fifth embodiments of the present invention.
Figure 3:
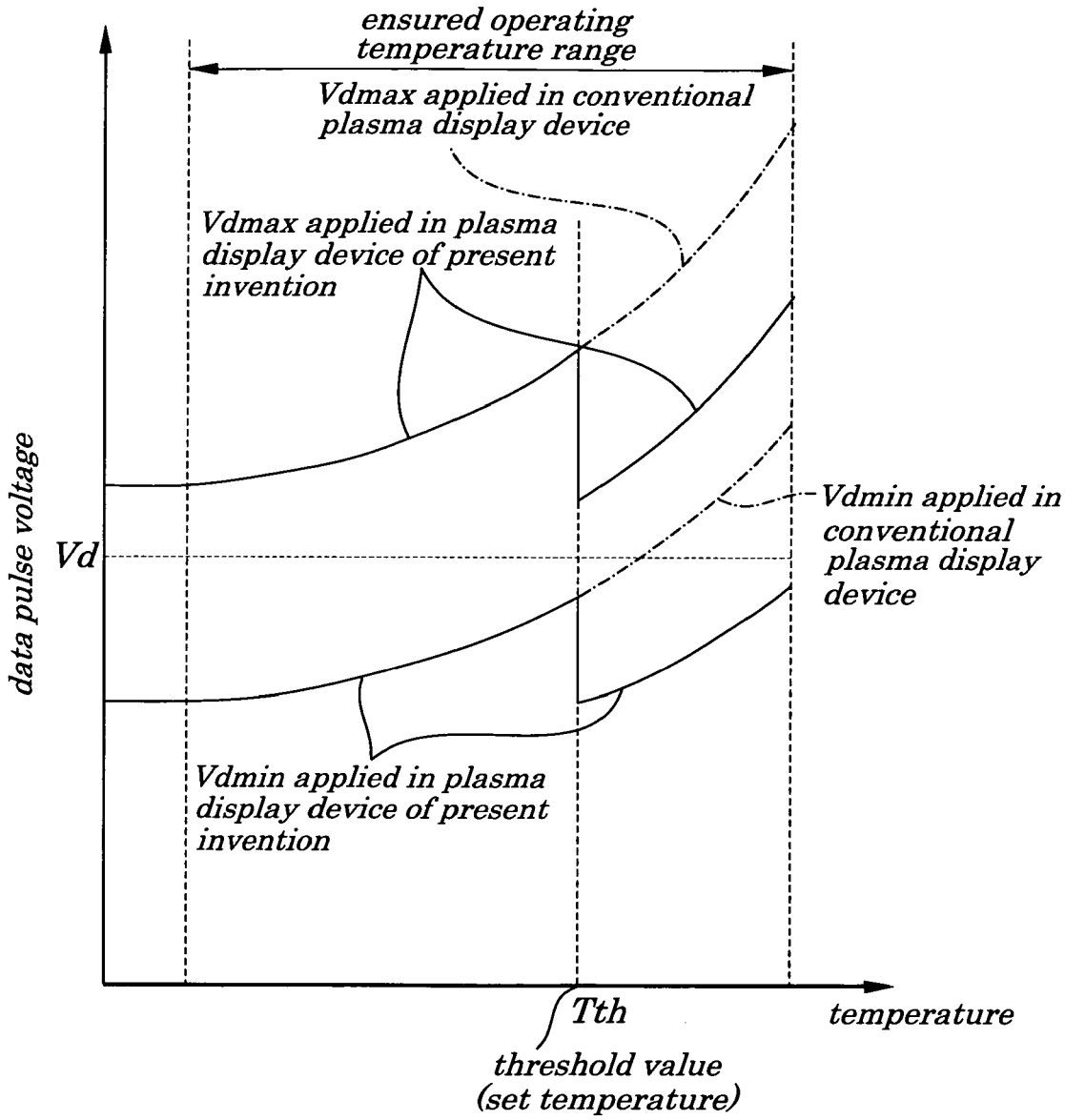
FIG. 3 is a diagram showing temperature dependence of maximum and minimum data pulse voltages required for normal operations of the PDP used in the plasma display device of first embodiment of the present invention.
Figure 17:
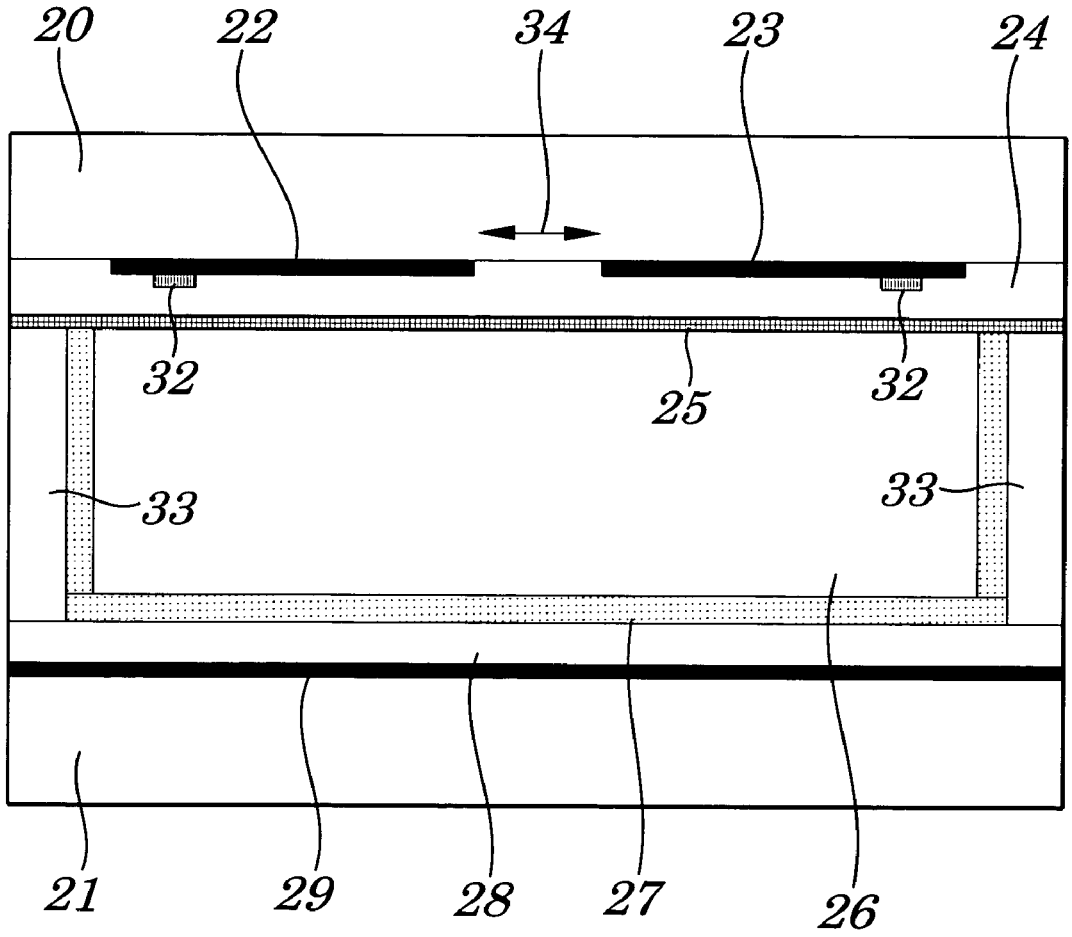
FIG. 17 (PRIOR ART)
FIG. 17 is a cross-sectional view showing configurations of one cell in a conventional three-electrode AC plasma display panel.
Figure 18:
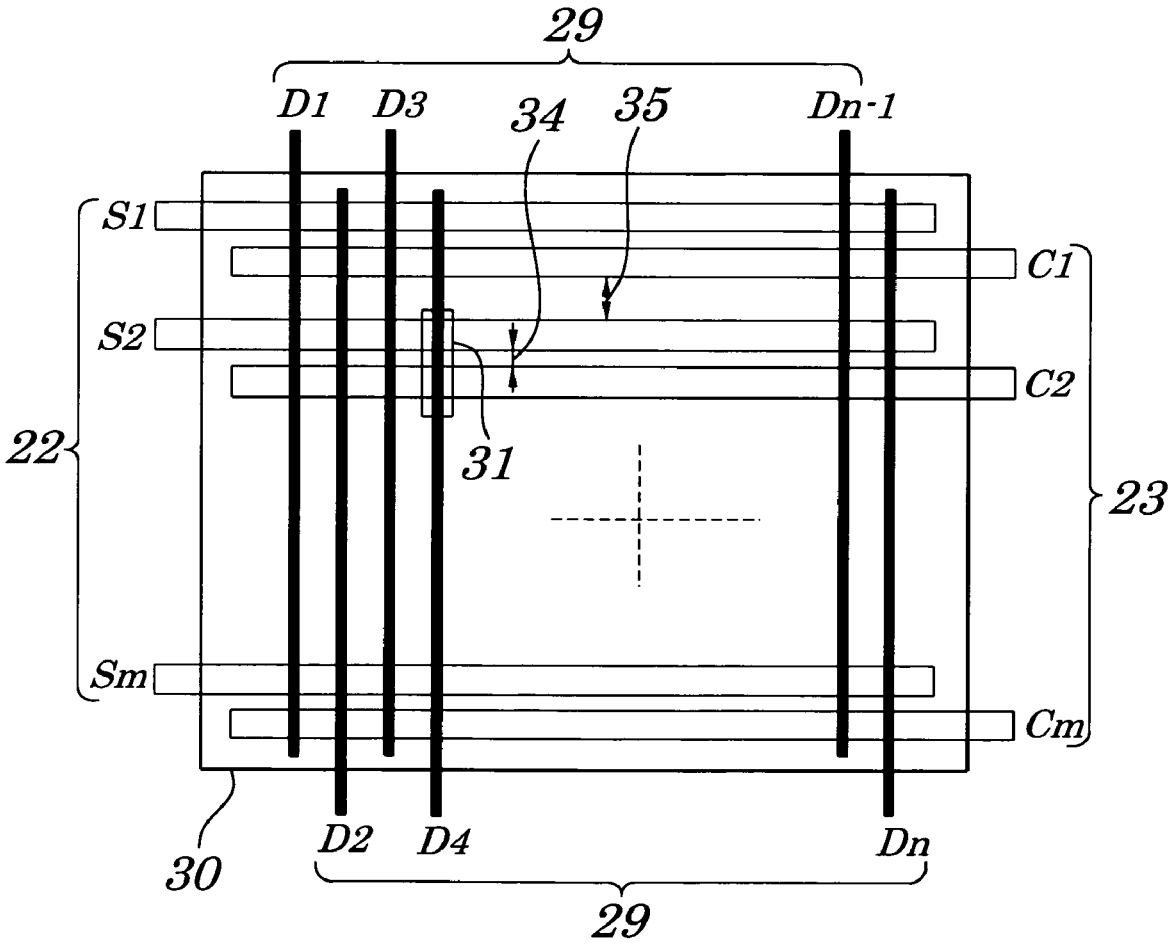
FIG. 18 (PRIOR ART)
FIG. 18 is a plan view illustrating configurations of the conventional AC plasma display panel.

FIGS. 1A and 1B are diagrams showing driving waveforms of pulses applied immediately before, after, and during an initializing period in a PDP used in a plasma display panel of a first embodiment of the present invention. FIG. 2A is a diagram showing a relation between time and temperature in a period during which a voltage changes during the wall charge adjusting period in the plasma display panel of the first embodiment. FIG. 3 is a diagram showing temperature dependence of minimum and maximum data pulse voltages required for normal operations of the PDP used in the plasma display device of the first embodiment. The PDP being used in the plasma display device of the first embodiment is the same as the conventional one shown in FIGS. 17 and 18 and their descriptions are omitted accordingly.

In the plasma display device of the first embodiment, in order to measure a panel temperature of the PDP, a temperature sensor is attached on a driving substrate in a rear of the panel. It is generally thought that a temperature of a discharge cell in a panel has a great influence on a discharge state in a PDP and, therefore, measurement of the temperature of the discharge cell itself is desirable, however, actually its measurement is impossible. Therefore, in the present invention, by attaching a temperature sensor on a driving substrate being a few short steps from the panel to indirectly to presume, based on the temperature measured by the temperature sensor, a panel temperature by conversion, the panel temperature is substantially obtained. Moreover, it is not always necessary that the temperature sensor is attached on the driving substrate in a rear of the panel and it can be attached at a location some distance within a set of a PDP without any difficulty and a panel temperature may be obtained based on a temperature measured in this location.

Next, a method for driving the plasma display device of the embodiment is described in detail. A basic configuration of a driving sequence during one sub-field being made up of operations during an initializing period 2, a scanning period 3, and a sustaining period 4 is the same as that in the conventional example shown in FIG. 19. FIGS. 1A and 1B show, in detail, driving waveforms of pulses to be applied during the initializing period 2 in the method for driving the PDP being used in the plasma display panel of the first embodiment. In the embodiment, a change rate of a scanning electrode voltage given by a waveform of a pulse to be applied to each of the scanning electrodes S during the wall charge adjusting period 10 is changed using a set temperature "Tth" of a PDP as a threshold.

FIG. 1A shows a case in which a panel temperature is lower than a set temperature. As shown in FIG. 1A, a potential of a scanning electrode 22 is gradually lowered, in a manner to correspond to a ramp waveform, from a potential being equivalent to an amplitude "Vs" of a sustaining pulse. After time "tpe 1" has elapsed, it lowers by a potential difference "Vpe" and a potential difference between each of the scanning electrodes and each of the data electrodes 29, after having been put into a state of a final ultimate potential difference, is maintained at a same potential for a constant holding period "tw". At this time point, a final ultimate potential (Vs−Vpe) of each of the scanning electrodes 22 is made almost the same as that of a scanning pulse 6.

Also, FIG. 1B shows a case in which a panel temperature is higher than the set temperature. As shown in FIG. 1B, a potential of the scanning electrode 22 is gradually lowered, in a manner to correspond to a ramp waveform, from a potential being equivalent to the amplitude "Vs" of the sustaining pulse. After time "tpe 2" has elapsed, it lowers by a potential difference "Vpe" and a potential difference between each of the scanning electrodes 22 and each of the data electrodes 29, after having been put into a state of a final ultimate potential difference, is kept at a same potential for a constant holding period "tw" as in the case in which the panel temperature is lower than the set temperature. At this time point, a final ultimate potential (Vs−Vpe) of each of the scanning electrodes is made almost the same as that of a scanning pulse 6 as in the case in which the panel temperature is lower than the set temperature.

FIG. 2A shows a relation between time and set temperature in a period during which a voltage changes during the wall charge adjusting period 10 in the first embodiment of the present invention in which "tpe" represents time during which a voltage to be applied to each of the scanning electrodes changes and, when a measured temperature is lower than a set temperature "Tth", a change rate of a scanning electrode voltage is represented by "Vpe/tpe1" where "Vpe" denotes a change width of a voltage in a period during which a voltage to be applied to each of the scanning electrodes is gradually lowered during the wall charge adjusting period 10 and, when the measured temperature is higher than the set temperature "Tth", the change rate of the scanning electrode voltage is represented by "Vpe/tpe2" which is made smaller than the "Vpe/tpe1".

As shown in FIG. 2A, when a panel temperature is higher than the set temperature, by decreasing a change rate of a voltage to be applied to each of the scanning electrodes, discharge intensity of feeble discharge occurring in the wall charge adjusting period 10 is lowered. In this state, an amount of space charges formed by discharge varies depending on discharge intensity and, the higher the discharge intensity is, the more space charges are formed, which causes an amount of wall charges to be formed on an electrode to increase.

When a change rate of a voltage to be applied to each of the scanning electrodes is made small, the discharge intensity becomes low and, therefore, an amount of wall charges that changes by discharge in the wall charge adjusting period 10 becomes small. During a priming period 9, a negative wall charge is formed on the scanning electrode S and a positive wall charge is formed on a data electrode D. During the wall charge adjusting period 10, since a potential difference between the scanning electrode S and data electrode D gradually changes, wall charges formed on the scanning electrode S and data electrode D come to decrease in a manner to have a polarity being reverse to that during the priming period 9. In this state, since the scanning pulse 6 is of negative polarity and a data pulse 7 is of positive polarity, negative wall charges on the scanning electrode S are superimposed on the voltage of the scanning pulse 6, positive wall charges on the data electrode D are superimposed on the voltage of the data pulse 7, and the increased amounts of wall charges cause writing discharge to easily occur.

Thus, when the panel temperature is higher than the set temperature, by decreasing a change rate of a scanning electrode voltage in the wall charge adjusting period 10, it is possible to let writing discharge easily occur and to lower a minimum data pulse voltage "Vdmin" required for occurrence of writing discharge.

FIG. 3 shows temperature dependence of the minimum data pulse voltage "Vdmin" required for occurrence of writing discharge and a characteristic in the conventional method is shown by alternating dot/dashed lines. In the conventional method, the minimum data pulse voltage "Vdmin" increases as a temperature rises and, within an ensured operating temperature range, the voltage "Vdmin" exceeds the set voltage "Vd", causing occurrence of a writing failure. However, according to the driving method of the present invention, since a change rate of a scanning electrode voltage in the wall charge adjusting period 10 is made small at a threshold of the set temperature "Tth", the minimum data pulse voltage "Vdmin" required for occurrence of writing discharge has been lowered, which enables the data pulse voltage "Vdmin" to be lower than the set voltage within the ensured operating temperature range. Therefore, according to the driving method of the plasma display device of the present invention, a writing failure caused by a rise in a temperature can be eliminated within the ensured operating temperature range.

On the other hand, when the panel temperature is lower than the set temperature, contrary to the above case, a state of easy occurrence of writing discharge occurs. Due to this, by application of the data pulse 7 to perform writing on other scanning line, a state that no scanning pulse is applied occurs, which causes erroneous discharge to occur between each of the scanning electrodes 22 and each of the data electrodes 29. Then, when such the erroneous discharge occurs, erroneous discharge occurs during the sustaining period 4, causing display by the erroneous cell lighting to appear.

An upper limit voltage "Vdmax" at which erroneous discharge does not occur between each of the scanning electrodes 22 and each of the data electrodes 29 in a period during which no scanning pulse 6 is applied during the scanning period 3 is lowered as a temperature falls more. In the embodiment, as shown in FIG. 2A, since a change rate of a scanning electrode voltage is changed using the set temperature "Tth" as a threshold voltage, discharge does not easily occur, when the panel temperature is lower than the set temperature. As a result, the voltage "Vdmax" being an upper limit value of the data pulse voltage "Vd" at which no erroneous discharge would occur is boosted on a low temperature side at the threshold of the set temperature "Tth".

Thus, according to the method for driving the plasma display device of the first embodiment, by changing a change rate of a scanning electrode voltage during the wall charge adjusting period 10 using the set temperature "Tth" as the threshold, variations in the minimum data pulse voltage "Vdmin" required for occurrence of writing discharge and in the voltage "Vdmax" being an upper limit value of the data pulse voltage "Vd" at which no erroneous discharge would occur, which is caused by the panel temperature, is reduced, which enables normal operations at the set voltage "Vd" of the data pulse voltage in all ensured operating temperature ranges.

Second Embodiment

Figure 4A:
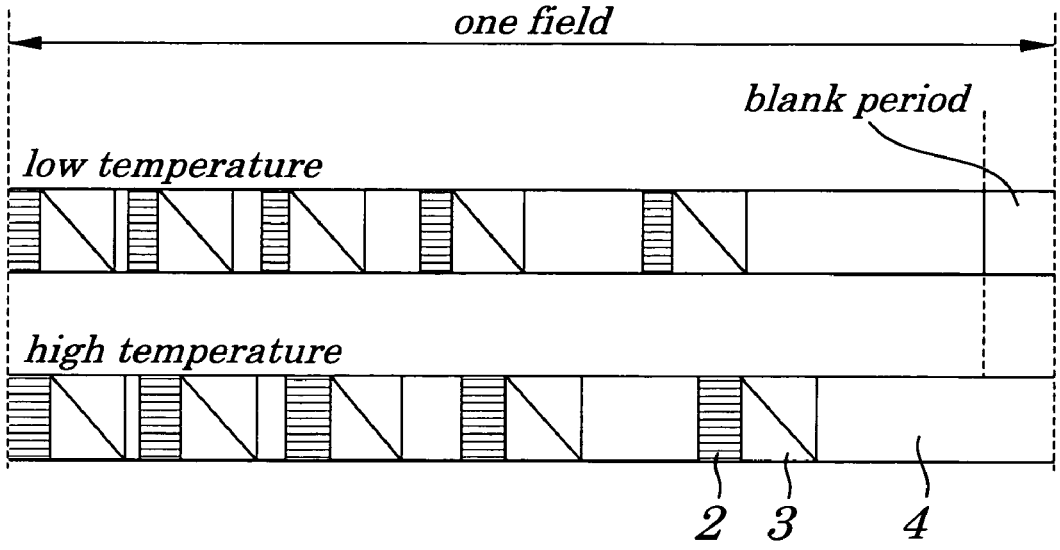
FIGS. 4A and 4B are diagrams showing configurations making up one field employed in a PDP respectively for the first and second embodiments of the present invention.
Figure 4B:
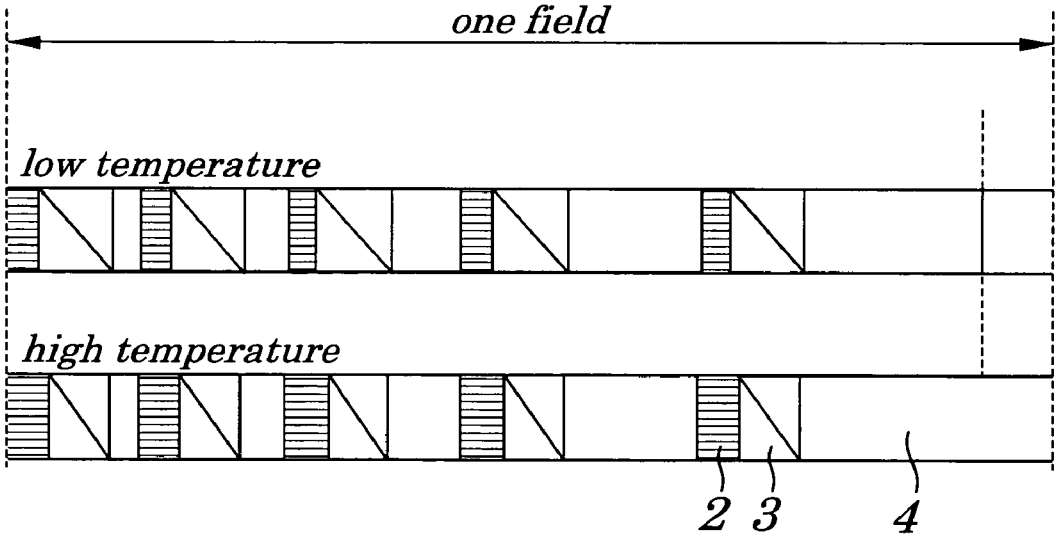
Figure 5A:
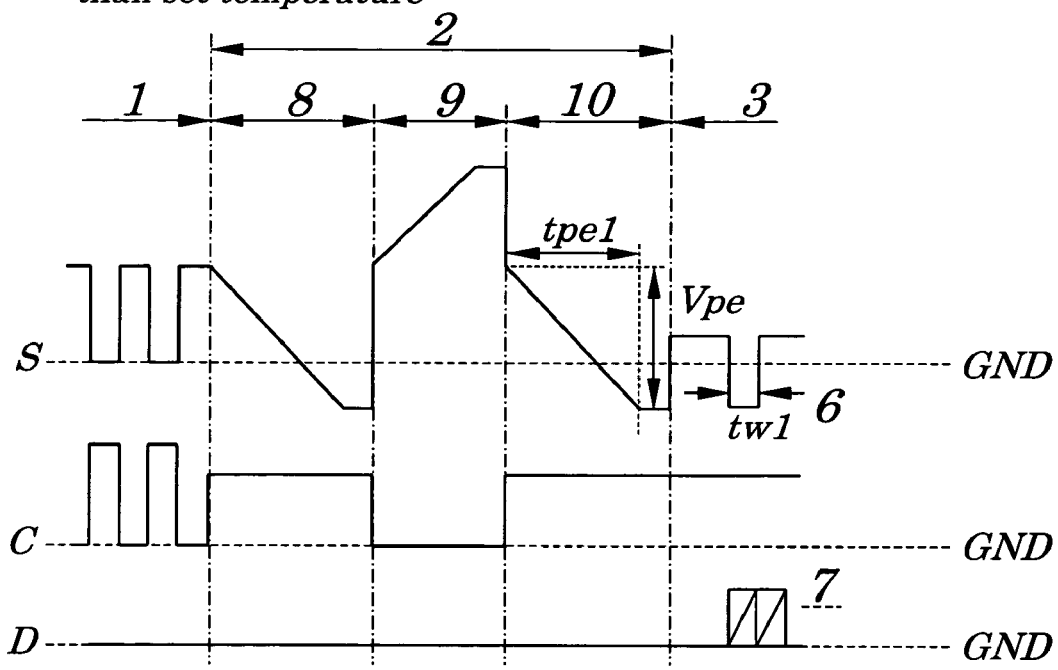
FIGS. 5A and 5B are diagrams showing driving waveforms of pulses applied immediately before, after, and during an initializing period in the PDP used in the plasma display device of the second embodiment of the present invention.
Figure 5B:
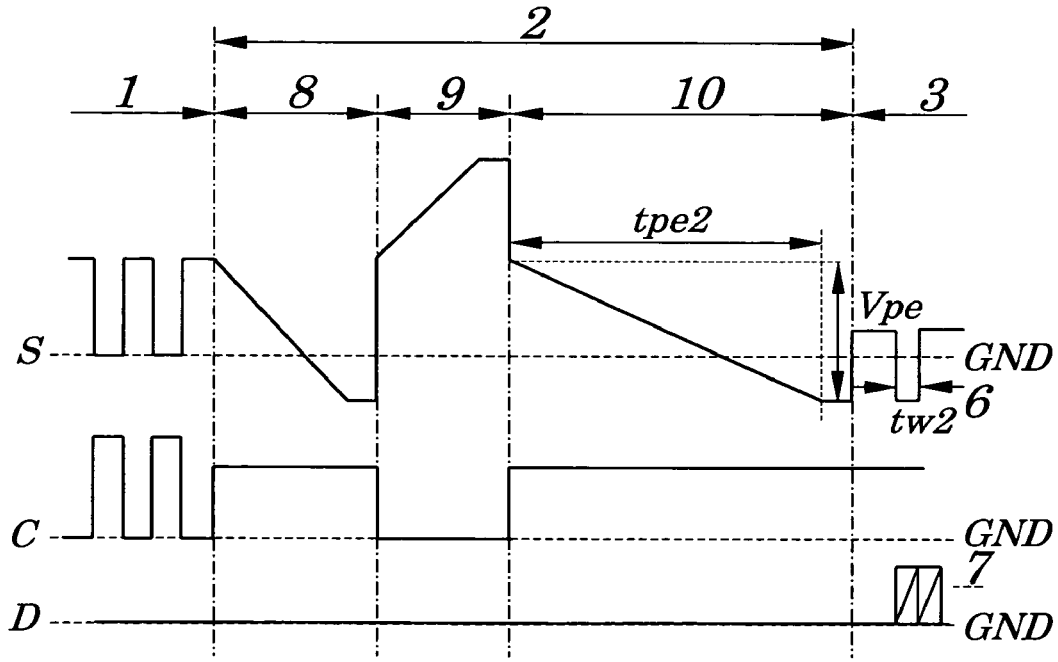

FIGS. 4A and 4B are diagrams showing configurations making up one field employed in a PDP respectively for the first and second embodiments of the present invention. FIGS. 5A and 5B are diagrams showing driving waveforms of pulses applied, when a panel temperature is lower or higher than a set temperature, immediately before, after, and during an initializing period in the PDP used in the plasma display device of the second embodiment of the present invention. The configurations of the PDP being used in the plasma display device of the second embodiment are the same as those of the conventional one shown in FIGS. 17 and 18. In the second embodiment, as in the first embodiment, a temperature sensor is attached on a driving substrate in a rear of a panel so as to measure the panel temperature.

The method for driving the PDP of the second embodiment is the same as that employed in the first embodiment except that, in the driving waveforms of pulses to be applied when the panel temperature is higher than a set temperature "Tth", a width of a scanning pulse 6 applied during the scanning period 3 is made smaller than that employed in the case in which the panel temperature is lower than the set temperature "Tth". That is, in the second embodiment, the method in which a change rate of a scanning electrode voltage during the wall charge adjusting period 10 is changed in a different way between the case in which the panel temperature is lower than the set temperature and the case in which the panel temperature is higher than the set temperature and the method for setting the final ultimate potential difference and holding period in these cases are the same as in the first embodiment.

In the first embodiment, only in the wall charge adjusting period 10, the method is switched according to the panel temperature. However, the number of or width of scanning pulses during the scanning period 3 and sustaining period 4 is not switched. As a result, time required for one image to be written is different depending on whether the panel temperature is higher or lower than the set temperature. That is, as shown in FIG. 4A in which one field is made up of five sub-fields, when the panel temperature is lower than the set temperature, the initializing period 2 that includes the wall charge adjusting period 10 is made shorter and a blank period during which no discharge occurs at all exists in a last portion making up the one field.

Figure 19:
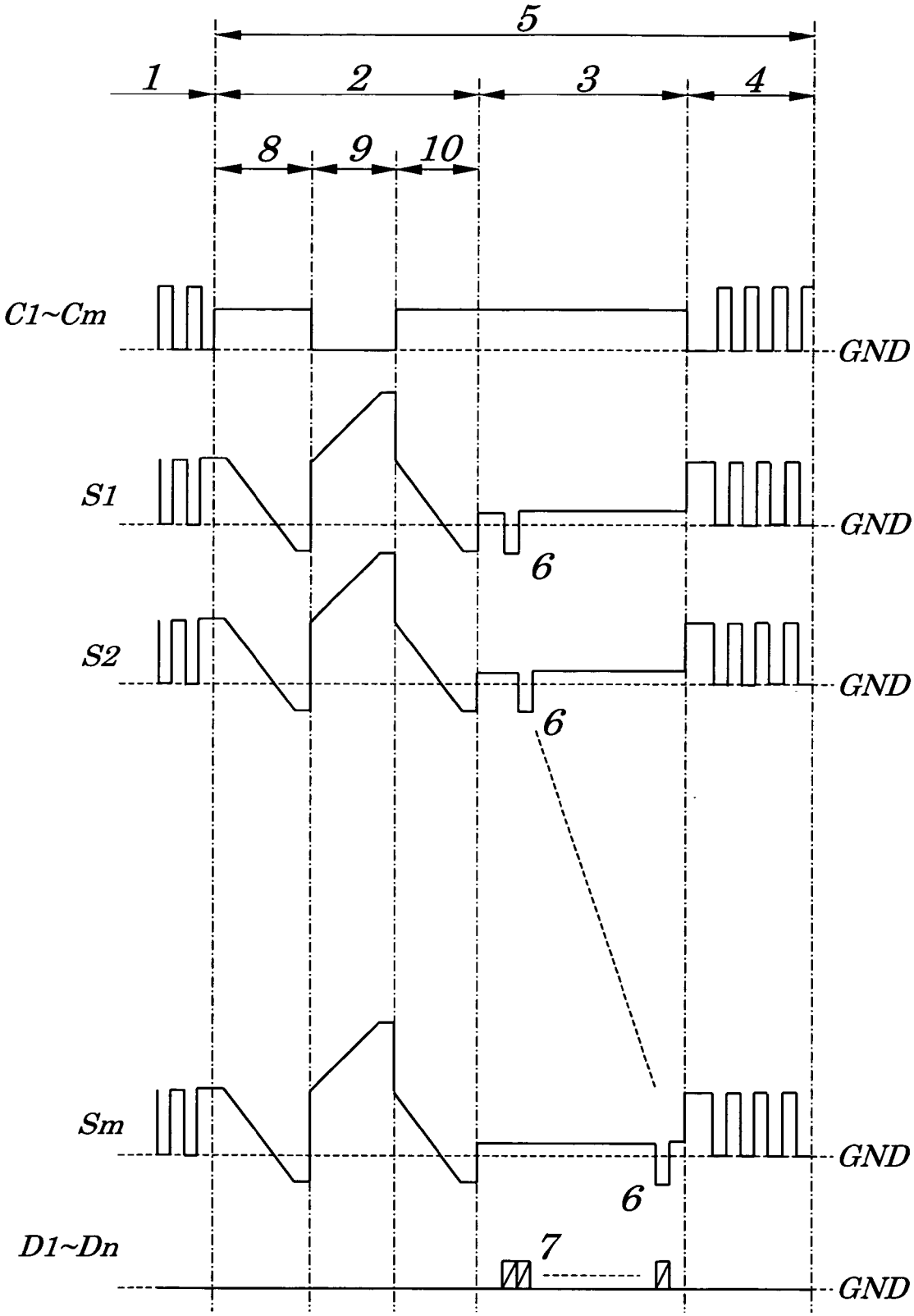
FIG. 19 (PRIOR ART)
FIG. 19 is a diagram showing driving waveforms of pulses to be applied in the conventional AC plasma display panel.

As shown in FIG. 19, according to the conventional method for driving a PDP in various products employed presently, in many cases, one sub-field includes the initializing period 2, scanning period 3, and sustaining period 4. Since discharge for displaying is made to occur only in the sustaining period 4, in order to enhance display luminance, it is desirable that the sustaining period 4 is made as long as possible and the number of sustaining pulses is made as large as possible. However, a problem is presented in the first embodiment in that, as shown in FIG. 4A, since there exists the blank period when the panel temperature is low, it is impossible to make effective use of time that can contribute to occurrence of discharge in one field.

To solve this problem, in the second embodiment, as shown in FIGS. 5A and 5B, when a panel temperature is higher than a set temperature, by making longer operating time during the wall charge adjusting period 10 compared with the case when the panel temperature is lower than the set temperature and by making shorter a width of a scanning pulse 6 during the scanning period 3 from the width "tw1" employed in the case when the panel temperature is lower than the set temperature to the width "tw2", operating time in the scanning period 3 is shortened compared with the case when the panel temperature is lower than the set temperature.

Discharge in a cell does not occur immediately after application of a voltage but with some time delay. At this point, time required before discharge occurs at a level that presents no problem in obtaining a display characteristic exceeding a specified level is called "discharge delay time". In writing discharge also, this discharge delay time has to be shorter than a width of a scanning pulse. In general, the discharge delay time tends to become short as the temperature rises. Therefore, when the panel temperature becomes higher than the set temperature, even if a width of a scanning pulse is shortened by a width being longer than the discharge delay time, no writing discharge occurs.

By shortening a width of a scanning pulse applied when a panel temperature is higher than a set temperature, time period obtained by making long the wall charge adjusting period 10 when the panel temperature is higher than the set temperature can be compensated for by shortening the scanning period 3 obtained by reducing a width of a scanning pulse. Moreover, as shown in FIG. 4B, since time required to display one image when the panel temperature is lower than the set temperature is made equal to time required to display one image when the panel temperature is higher than the set temperature, unlike in the case of the first embodiment shown in FIG. 4A, in the second embodiment, it is not necessary to provide a blank period. On the other hand, according to a characteristic of temperature dependence of the minimum data pulse voltage "Vdmin" required for occurrence of writing discharge, as in the case of the first embodiment shown in FIG. 3, normal operations can be performed at the set voltage "Vd" of the data pulse within the ensured operating temperature range.

Thus, according to the method of driving the plasma display device of the second embodiment, by decreasing a change rate of a scanning electrode voltage to be applied when the panel temperature is higher than the set temperature, since time period obtained by lengthening operating time during the wall charge adjusting time 10 can be compensated for by shortening the scanning period 3 obtained by reducing a width of a scanning pulse, time required to display one image when the panel temperature is lower than the set temperature is made equal to time required to display one image when the panel temperature is higher than the set temperature, enabling setting of the blank period during which no discharge occurs to be omitted.

Third Embodiment

Figure 2B:
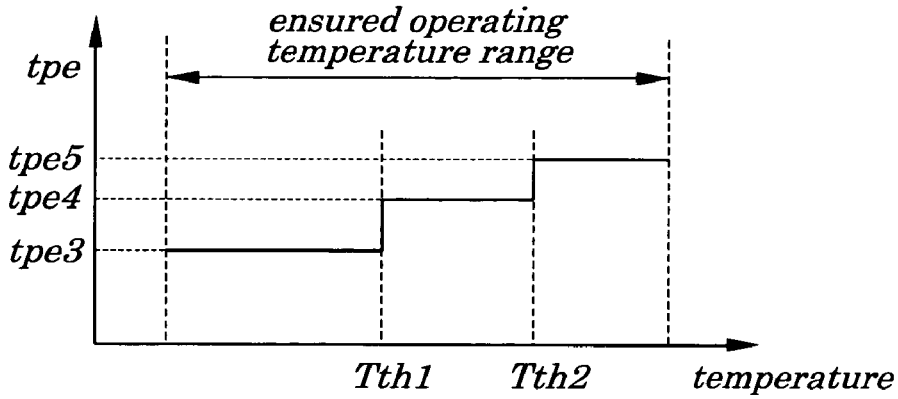
Figure 6:
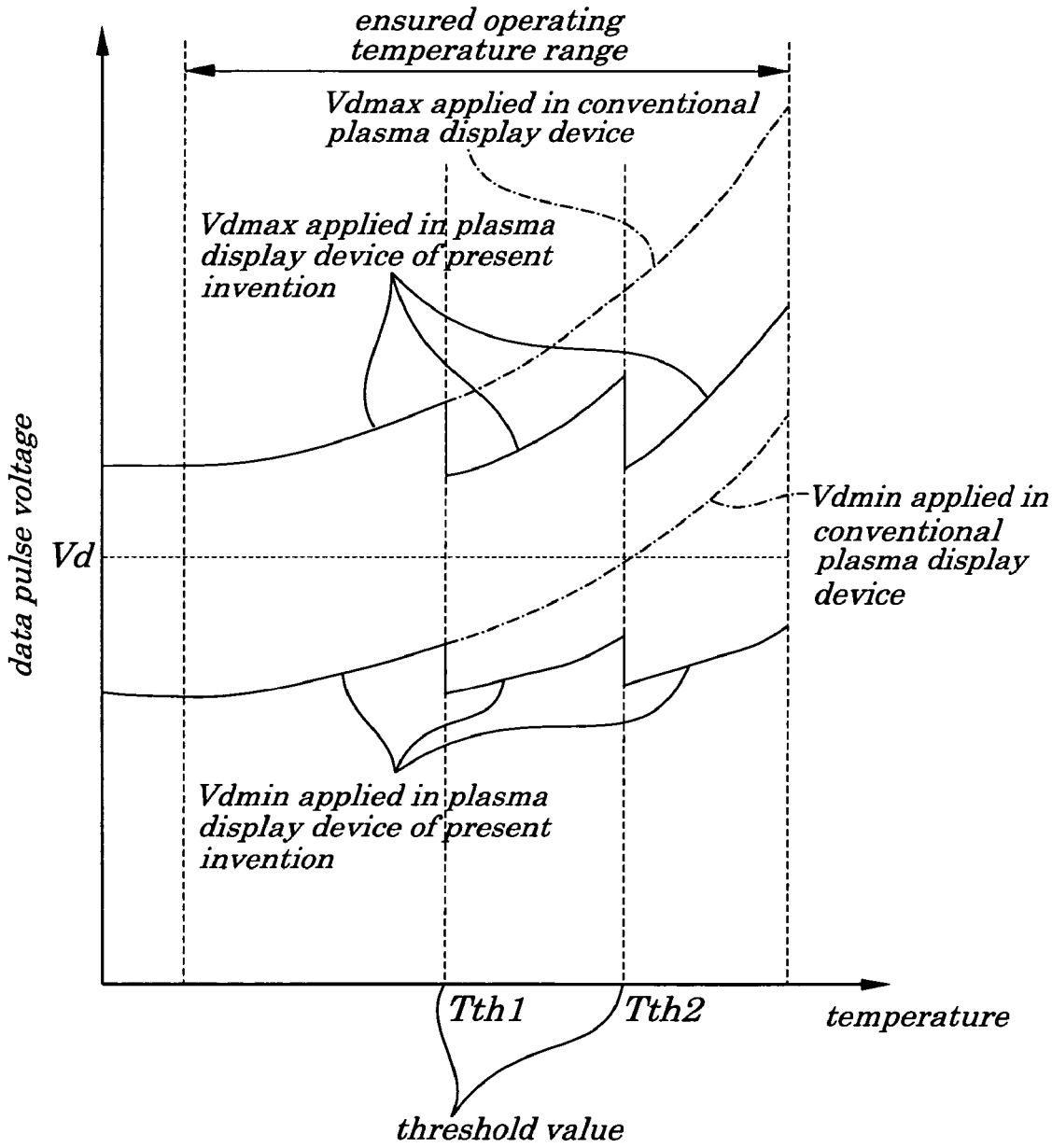
FIG. 6 is a diagram showing temperature dependence of maximum and minimum data pulse voltages required for normal operations of a PDP used in a plasma display device of the third embodiment of the present invention.

FIG. 2B is the diagram showing the relation between time and temperature in a period during which a voltage changes during wall charge adjusting period in the third embodiment of the present invention. FIG. 6 is a diagram showing temperature dependence of maximum and minimum data pulse voltages required for normal operations of the PDP used in the plasma display device of the third embodiment of the present invention. The configurations of the PDP being used in the plasma display device of the third embodiment are the same as those of the conventional one shown in FIGS. 17 and 18. In the third embodiment, a temperature sensor is also attached on a driving substrate in a rear of a panel so as to measure a panel temperature.

In the method for driving the PDP of the third embodiment, as shown in FIG. 2B, basic configurations of driving waveforms of applied pulses and operations for changing a change rate of a scanning electrode voltage during the wall charge adjusting period 10 are the same as those in the first embodiment of the present invention, except that two set temperatures such as "Tth1" and "Tth2" each serving as a threshold value when a change rate of a scanning electrode voltage is changed are provided.

In the third embodiment, a change rate of a scanning electrode voltage in the wall charge adjusting period 10 is varied in three stages including a case in which a panel temperature is lower than the set temperature "Tth1", another case in which the panel temperature is at an intermediate level between the set temperatures "Tth1" and "Tth2", and another case in which the panel temperature is higher than the set temperature "Tth2".

In the third embodiment, since a change rate of a scanning electrode voltage is changed bit by bit compared with the case of the first embodiment shown in FIG. 2A, temperature dependence of the minimum data pulse "Vdmin" required for occurrence of writing discharge can be reduced as shown in FIG. 6. Moreover, a decrease, that may occur when the panel temperature is lower than the set temperature, in dependence of a voltage "Vdmax" being an upper limit value of a data pulse voltage "Vd" at which no erroneous discharge would occur between each of the scanning electrodes 22 and each of the data electrodes 29 can be also suppressed.

Thus, according to the method for driving the plasma display device of the third embodiment, by changing a change rate of a scanning electrode voltage in the wall charge adjusting period 10 using the set temperatures "Tth1" and "Tth2" as a threshold value to reduce variations in the minimum data pulse voltage "Vdmin" required for occurrence of writing discharge and in the voltage "Vdmax" being an upper limit value of the data pulse voltage "Vd" at which no erroneous discharge would occur, normal operations can be performed at the set data pulse voltage "Vd" within all ensured operating temperature ranges.

Fourth Embodiment

Figure 2C:
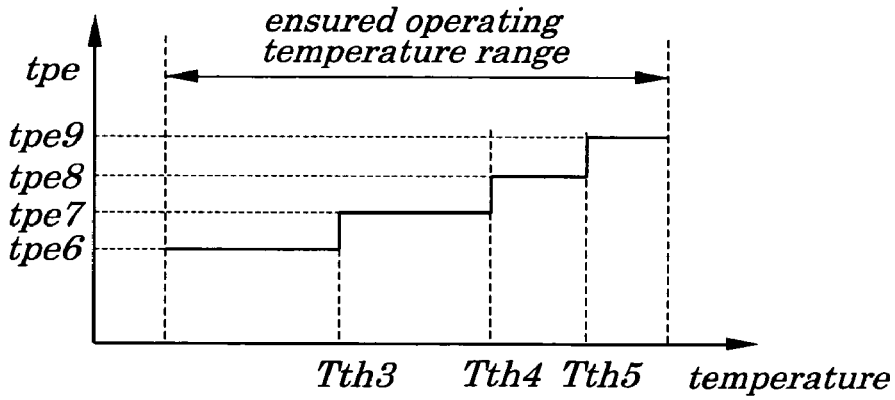
Figure 7:
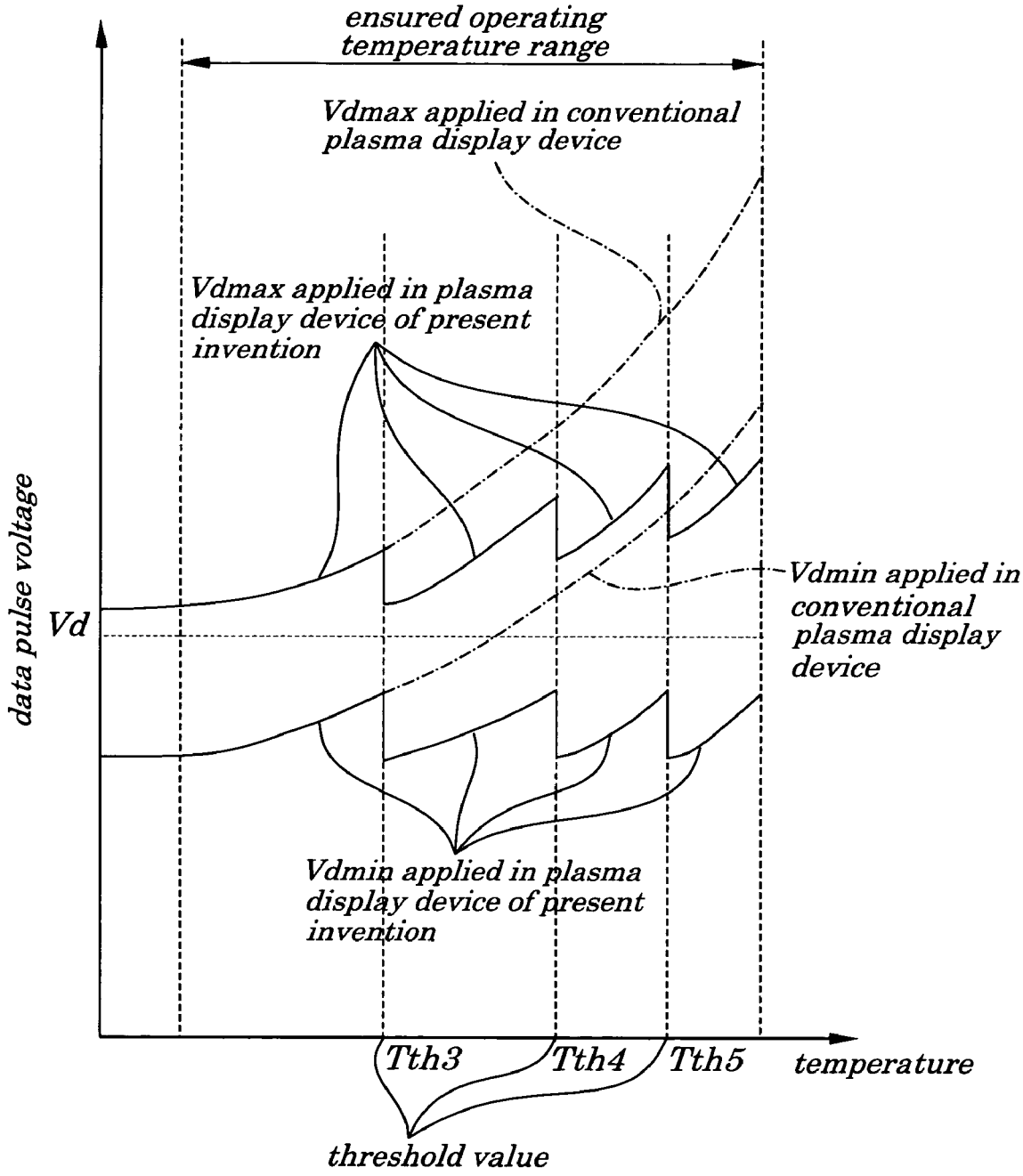
FIG. 7 is a diagram showing temperature dependence of maximum and minimum data pulse voltages required for normal operations of a PDP used in a plasma display device of the fourth embodiment of the present invention.

FIG. 2C is the diagram showing the relation between time and temperatures in a period during which a voltage changes during wall charge adjusting period in the fourth embodiment of the present invention. FIG. 7 is a diagram showing temperature dependence of maximum and minimum data pulse voltages required for normal operations of a PDP used in a plasma display device of the fourth embodiment of the present invention. The configurations of the PDP being used in the plasma display device of the fourth embodiment are the same as those of the conventional one shown in FIGS. 17 and 18. In the fourth embodiment, a temperature sensor is also attached on a driving substrate in a rear of a panel so as to measure a panel temperature.

Generally, in a PDP, temperature dependence of the data pulse voltage "Vdmin" required for occurrence of writing discharge varies depending on a cell pitch, configurations of an electrode, film thickness of a dielectric, or a like. If a change rate of a scanning electrode voltage in a PDP in the wall charge adjusting period 10 is a constant rate of "Vpe/tpe 1" in an ensured operating temperature rate as in the conventional example, as shown by alternating dot/dashed lines in FIG. 7, the data pulse voltage "Vdmin" increases when the panel temperature is higher than the set temperature when compared with the case of the first embodiment. Thus, in the driving method of the PDP of the fourth embodiment, the set temperature serving as a threshold value to be used when a change rate of a voltage in the wall charge adjusting period 10 is increased so as to become three values including "Tth3", "Tth4", and "Tth5" as shown in FIG. 2C.

By using this method, as shown by solid lines in FIG. 7, the minimum data pulse voltage "Vdmin" required for occurrence of writing discharge can be suppressed so as to lower than the voltage "Vd" being a set voltage and, therefore, no writing failure occurs. On the other hand, in a period during which the scanning pulse 6 is not applied, the voltage "Vdmax" being an upper limit value of the data pulse voltage "Vd" at which no erroneous discharge would occur between each of the scanning electrodes 22 and each of the data electrodes 29, as shown by solid lines in FIG. 7, does not become under the voltage "Vdmax" corresponding to a lowest temperature within the ensured operating temperature range employed in the conventional driving method shown by alternating dot/dashed lines in FIG. 7 and, therefore, normal operations can be performed at the set data pulse voltage "Vd" within all ensured operating temperature ranges.

Thus, according to the method for driving the plasma display device of the fourth embodiment, by changing a change rate of a scanning electrode voltage in the wall charge adjusting period 10 using the set temperatures "Tth3", "Tth4", and "Tth5" as thresholds to reduce variations in the minimum data pulse voltage "Vdmin" required for occurrence of writing discharge and in the voltage "Vdmax" being an upper limit value of the data pulse voltage "Vd" at which no erroneous discharge would occur, normal operations can be performed at the set data pulse voltage "Vd" within all ensured operating temperature ranges.

Fifth Embodiment

Figure 2D:
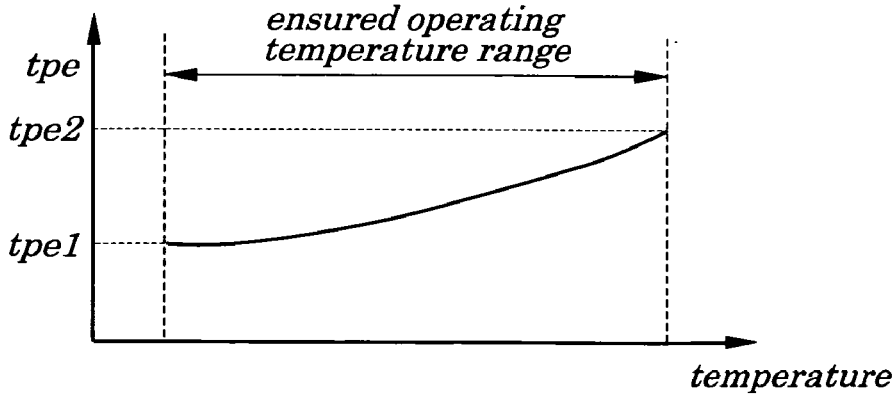
Figure 8:
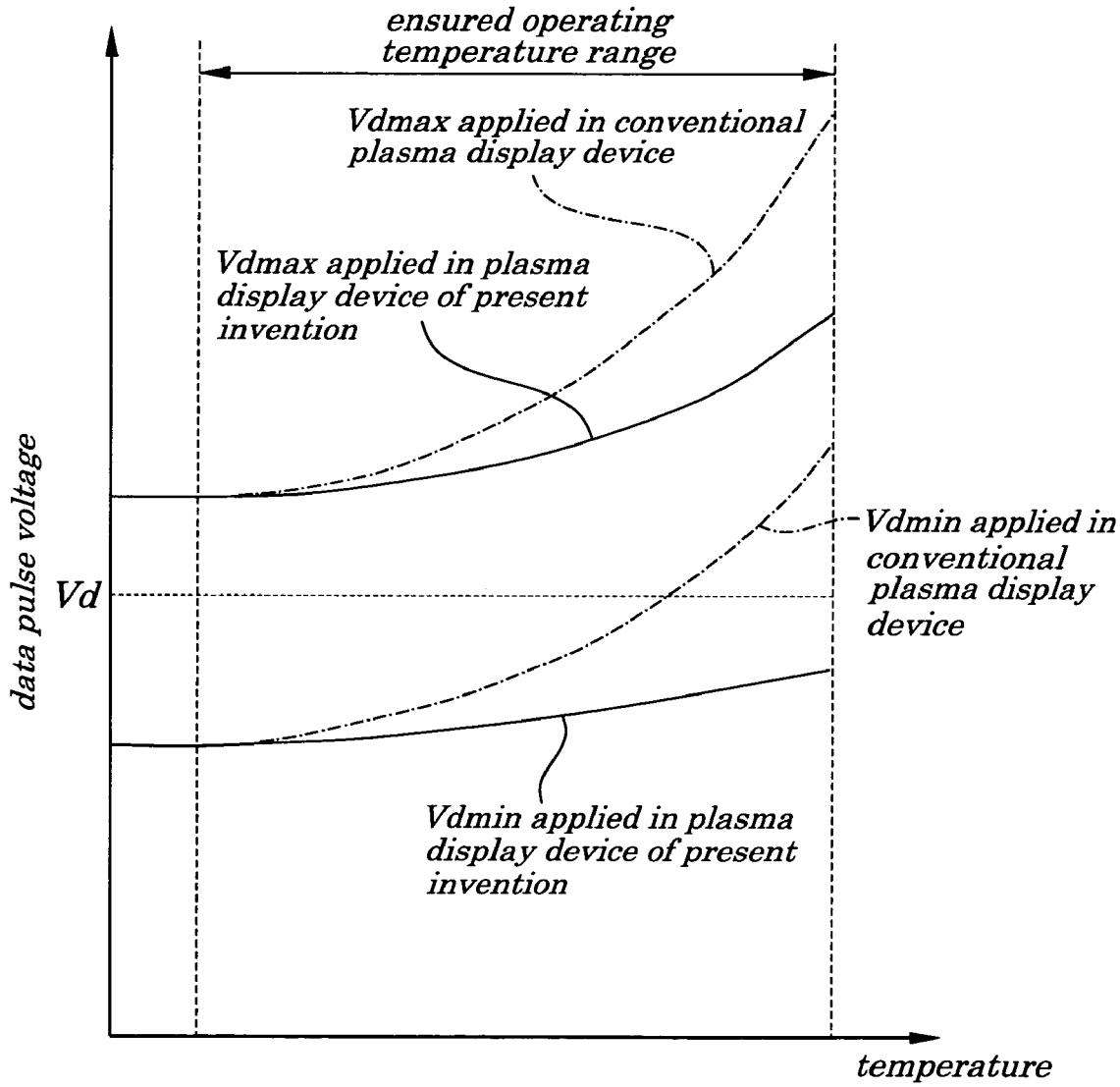
FIG. 8 is a diagram showing temperature dependence of maximum and minimum data pulse voltages required for normal operations of a PDP used in a plasma display device of the fifth embodiment of the present invention.

FIG. 2D is the diagram showing a relation between time and temperatures in a period during which a voltage changes in a wall charge adjusting period in the fifth embodiment of the present invention. FIG. 8 is a diagram showing a temperature dependence of maximum and minimum data pulse voltages required for normal operations of a PDP used in a plasma display device of the fifth embodiment of the present invention. Configurations of the PDP being used in the plasma display device of the fifth embodiment are the same as those of the conventional one shown in FIGS. 17 and 18. In the fifth embodiment, a temperature sensor is also attached on a driving substrate in a rear of a panel so as to measure a panel temperature.

The method for driving the PDP of the fifth embodiment is the same as that employed in the first embodiment except that a change rate of a scanning electrode voltage is continuously varied in a manner to correspond to a panel temperature as shown in FIG. 2D. In the fifth embodiment, by continuously varying a change rate of a scanning electrode voltage in the wall charge adjusting period 10, as shown in FIG. 8, temperature dependence of the minimum data pulse voltage "Vd" required for occurrence of writing discharge and the voltage "Vdmax" being an upper limit value of the data pulse voltage "Vd" at which no erroneous discharge would occur are also varied continuously and, therefore, such a discontinuous increase of the data pulse voltage "Vdmin" occurring at switching time when the panel temperature becomes lower than the set temperature "Tth" for changing the change rate, for example, as shown in FIG. 3 in the first embodiment can be eliminated and, further, such a discontinuous decrease of the data pulse voltage "Vmax" occurring at switching time when the panel temperature becomes higher than the set temperature "Tth" for changing the change rate, for example, also as shown in FIG. 3 in the first embodiment can be also eliminated, which enables suppression of reduction in a driving margin of a data pulse voltage at each of switching set temperatures.

Thus, according to the method for driving the plasma display device of the fifth embodiment, by continuously varying a change rate of a scanning electrode voltage during the wall charge adjusting period 10 to reduce variations in a minimum data pulse voltage "Vdmin" required for occurrence of writing discharge and in a voltage "Vdmax" being an upper limit value of the data pulse voltage at which no erroneous discharge would occur, normal operations can be performed at a set data pulse voltage "Vd" during all ensured operating temperature ranges and such reduction in an operating margin of the data pulse voltage at each of the switching set temperatures as in the case in which the set temperature is switched can be suppressed.

Sixth Embodiment

FIG. 9A is a diagram showing time in a period during which a voltage changes during a wall charge adjusting period in a sub-field employed in a PDP of the sixth embodiment of the present invention. Configurations of the PDP being used in the plasma display device of the sixth embodiment are the same as those of the conventional one shown in FIGS. 17 and 18. In the sixth embodiment, a temperature sensor is also attached on a driving substrate in a rear of a panel so as to measure a panel temperature. In the sixth embodiment, basic configurations of driving waveforms of applied pulses are the same as those in the first embodiment of the present invention, however, as the set temperature to switch a change rate of a voltage in the wall charge adjusting period 10, only a temperature "Tth" is set.

In this embodiment, one field includes eight sub-fields. An approximate ratio of the number of sustaining pulses in each sub-field (shown as "SF" in FIGS. 9A, 9B, and 9C) is also shown in FIG. 9A. A ratio of the number of sustaining pulses in each sub-field is approximately proportional to light-emitting strength obtained when the sub-field is selected and sustaining discharge occurs. In FIG. 9A, "tpe" denotes time in a period during which a voltage changes in the wall charge adjusting period 10 in each of temperature ranges. A relation between the time "tpe1" and "tpe2" being time during which a voltage to be applied to each of the scanning electrodes changes linearly is "tpe1<tpe2" as shown in FIG. 2A and FIGS. 1A and 1B and a change rate of the scanning electrode voltage is smaller at the time "tpe2".

In the sixth embodiment, the operation to expand the wall charge adjusting period 10 when the panel temperature is higher than or equal to the set temperature is performed in only four sub-fields out of eight sub-fields and not in an other period. By operating as above, when compared with a case in which the changing of a change rate of a voltage is done during all sub-fields, the sustaining period 4 can be maintained long, and high display luminance can be obtained. In this case, since, in a sub-field during which a change rate of a voltage is not changed, a writing failure easily occurs, in the embodiment in which the number of sub-fields during which the change rate of the voltage is made small is limited in terms of time, as shown in FIG. 9A, by changing a change rate of a voltage in an early-stage sub-field during which the number of sustaining cycles is large, variations in luminance caused by erroneous turn-off of a cell can be reduced and erroneous turn-off of the cell is made inconspicuous when compared with a case in which the change rate of the voltage is changed in a late-stage sub-field during which the number of sustaining cycles is small.

Thus, according to the method for driving the plasma display device of the sixth embodiment, by exercising control to lengthen time during which a scanning electrode voltage changes when the panel temperature is higher than or equal to the set temperature only during a part of the sub-fields making up one field to make long a sustaining period in the sub-field other than the part of the sub-fields which serves to enhance display luminance and by exercising the same control as above during the early-stage sub-field, it is made possible to make inconspicuous erroneous turn-off of a cell.

Seventh Embodiment

FIG. 9B is a diagram showing time in a period during which a voltage changes in a wall charge adjusting period in a sub-field employed in a PDP of the seventh embodiment of the present invention. Configurations of the PDP being used in the plasma display device of the sixth embodiment are the same as those of the conventional one shown in FIGS. 17 and 18. In the sixth embodiment, a temperature sensor is also attached on a driving substrate in a rear of a panel so as to measure a panel temperature. In the seventh embodiment, basic configurations of driving waveforms of applied pulses are the same as those in the first embodiment of the present invention. Also, configurations of a sub-field in the seventh embodiment are the same as those in the sixth embodiment shown in FIG. 9A. Moreover, in the seventh embodiment, a width of a scanning pulse 6 to be applied when the panel temperature is higher than or equal to the set temperature is made small.

FIG. 9B shows time "tpe" and a width of a scanning pulse in a period during which a scanning electrode voltage changes in the wall charge adjusting period 10 in each of temperature ranges. Since, by shortening a width of a scanning pulse when the panel temperature is higher than or equal to the set temperature, the scanning period 3 can be made short, the number of sub-fields during which the change rate of a scanning-electrode voltage is made smaller when the panel temperature is higher than or equal to the set temperature is made larger compared with the case of the sixth embodiment, that is, the number of sub-fields are set to be six. In this case, as in the sixth embodiment, by changing the change rate of the voltage in an early-stage sub-field during which the number of sustaining cycles is large, variations in luminance caused by erroneous turn-off of a cell can be reduced and erroneous turn-off of the cell can be made inconspicuous.

Thus, according to the method for driving the plasma display device of the seventh embodiment, by shortening, when the panel temperature is higher than or equal to the set temperature "Tth", a scanning pulse width to make short the scanning period 3, the number of sub-fields making up one field in which control is exercised to lengthen time during the scanning electrode voltage changes during the wall charge adjusting period 10 when the panel temperature is higher than or equal to the set temperature can be made large and by exercising such the control in a sub-field existing on a side of the early-stage sub-field during which the number of sustaining pulses is large, erroneous turn-off of a cell can be made inconspicuous.

Eighth Embodiment

FIG. 9C is a diagram showing time in a period during which a voltage changes in a wall charge adjusting period in a sub-field employed in a PDP of an eighth embodiment of the present invention. Configurations of the PDP used in the plasma display device of the eighth embodiment are the same as those of the conventional one shown in FIGS. 17 and 18. In the eighth embodiment, a temperature sensor is also attached on a driving substrate in a rear of a panel so as to measure a panel temperature. In the eighth embodiment, basic configurations of driving waveforms of applied pulses are the same as those in the first embodiment of the present invention. Threshold temperatures at which a change rate of a voltage is changed in the wall charge adjusting period 10 are set in three stages as in the case of the third embodiment. Also, configurations of the sub-field employed in the eighth embodiment are the same as those in the sixth and seventh embodiments shown in FIGS. 9A and 9B.

FIG. 9C shows time in a period during which a scanning electrode voltage changes in the wall charge adjusting period 10 and in each of temperature ranges. In the eighth embodiment, as in the case of the sixth and seventh embodiments, by changing the change rate of a voltage in an early-stage sub-field during which the number of sustaining cycles is large, variations in luminance caused by erroneous turn-off of a cell can be suppressed and erroneous turn-off of the cell can be made inconspicuous. Also, since the change rate of a voltage is changed according to a temperature in three stages, as in the case of the third embodiment, temperature dependence of a minimum data pulse voltage "Vdmin" required for occurrence of writing discharge can be reduced. Moreover, temperature dependence of the voltage "Vdmax" being an upper limit value of the data pulse voltage "Vd" at which no erroneous discharge would occur can be made small.

In the eighth embodiment, a width of a scanning pulse is not controlled so as to be changed according to the temperature. However, by shortening the width of the scanning pulse when the panel temperature is higher than or equal to the set temperature, in more sub-fields, it becomes possible to decrease a change rate of a scanning electrode voltage during the wall charge adjusting period 10.

Thus, according to the method for driving the plasma display device of the eighth embodiment, by changing the change rate of the scanning electrode voltage in three stages according to the temperature and by exercising control to strengthen time during which the scanning electrode voltage changes during the wall charge adjusting period 10 when the panel temperature is higher than or equal to the set temperature, temperature dependence of a data pulse voltage "Vdmin" and a data pulse voltage "Vdmax" can be made small and by exercising such the control in the early-stage sub-field during which the number of the sustaining pulses is large, erroneous turn-off of a cell can be made inconspicuous.

Ninth Embodiment

Figure 10:
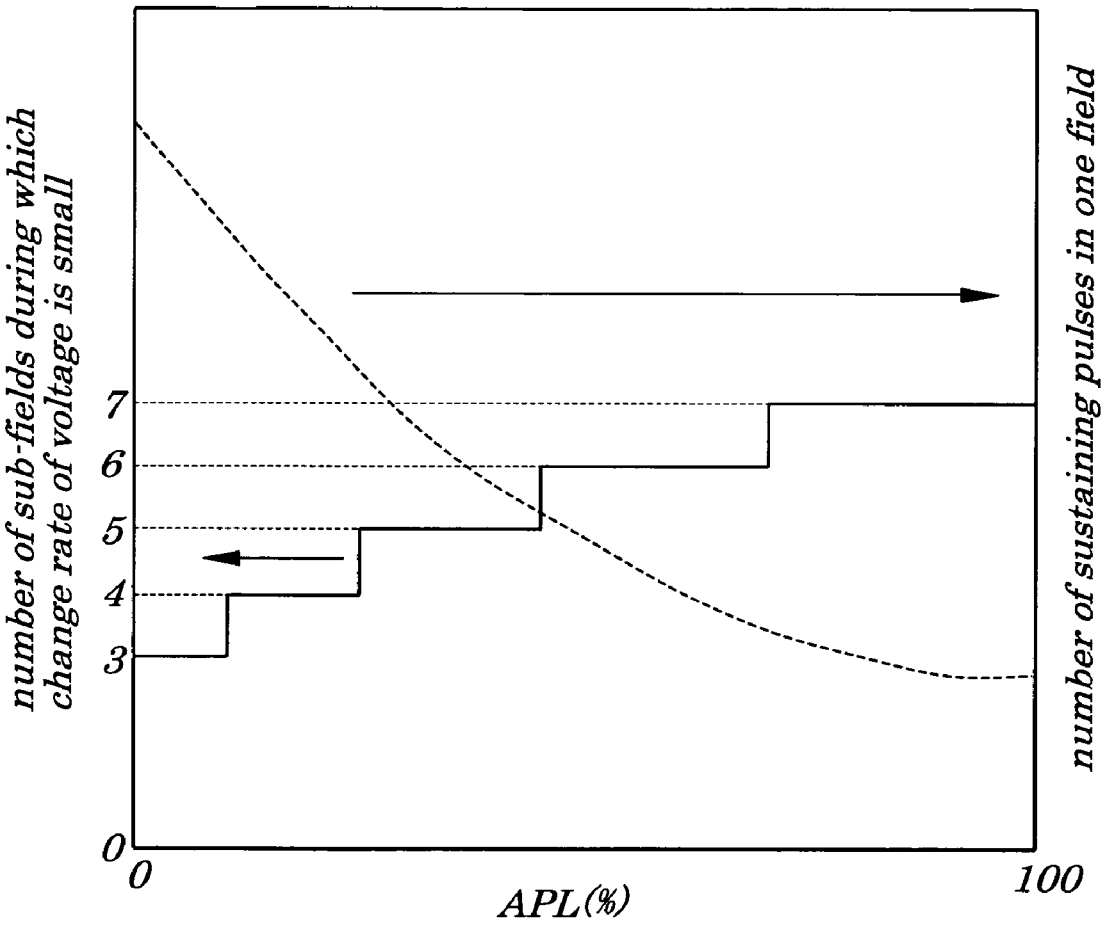
FIG. 10 is a diagram showing a relation between dependence on an image average number of gray scales to the number of sub-fields during which a change rate of a voltage is small in a PDP according to a ninth embodiment of the present invention.

FIG. 10 is a diagram showing a relation between dependence on the average number of gray scales for an image to the number of sub-fields having the small change rate of a voltage in a PDP according to the ninth embodiment of the present invention. Configurations of the PDP used in the plasma display device of the ninth embodiment are the same as those of the conventional one shown in FIGS. 17 and 18. In the ninth embodiment, a temperature sensor is also attached on a driving substrate in a rear of a panel so as to measure a panel temperature. In the ninth embodiment, basic configurations of driving waveforms of applied pulses are the same as those in the first embodiment of the present invention. During the wall charge adjusting period 10, a change rate of a voltage is changed once according to the temperature. Moreover, one field includes eight sub-fields.

In the ninth embodiment, a total number of sustaining pulses in one field is made to vary according to an average picture level (hereinafter may be referred to simply as an "APL") in an entire screen in such a manner to be shown by broken lines in FIG. 10. When the APL is high, by decreasing the number of sustaining pulses to lower display luminance so that display does not have too much glare to a viewer and to reduce power consumption.

Also, when the APL is low, by increasing the number of sustaining pulses, high luminance is provided in high-gray portion in a small area on a dark screen, which enables a screen to have good contrast and an attractive screen. Even if the number of sustaining pulses increases, since the APL is originally low, power consumption does not increase so much as a whole. To increase the number of sustaining pulses, the sustaining period 4 has to be lengthened. However, in the ninth embodiment, as shown by solid lines in FIG. 10, as the APL becomes the lower, the number of sub-fields during which the change rate of a voltage is made small is made to decrease the more.

In the ninth embodiment, as in the sixth to eighth embodiments, by changing a change rate of a voltage in the early-stage sub-field during which the number of sustaining pulses is larger, variations in luminance caused by a writing failure can be reduced and erroneous turn-off of a cell can be made inconspicuous.

Thus, according to the plasma display device of the ninth embodiment, when the APL is high, by reducing the total number of sustaining pulses applied in one field to lower display luminance and to reduce power consumption and, when the APL is low, by reducing the number of sub-fields during which a change rate of a scanning electrode voltage is made small to lengthen the sustaining period 4 and by increasing the number of sustaining pulses to enhance display luminance. In this case also, by changing a change rate of a voltage during an early-stage sub-field in which the number of sustaining pulses is large, erroneous turn-off of a cell can be made inconspicuous.

Tenth Embodiment

Figure 11:
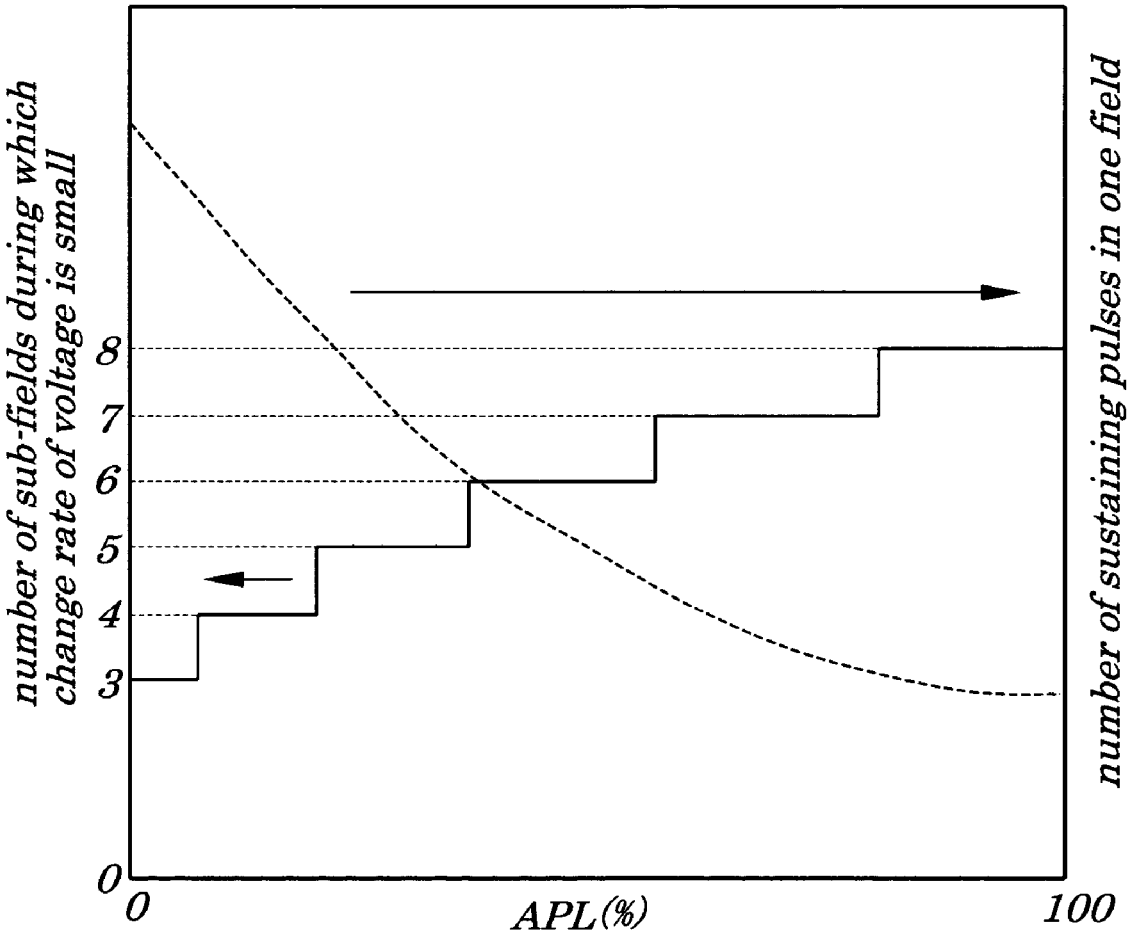
FIG. 11 is a diagram showing a relation between dependence on the image average number of gray scales to the number of sub-fields during which a change rate of a voltage is small in a PDP according to a tenth embodiment of the present invention.

FIG. 11 is a diagram showing a relation between dependence on the image average number of gray scales to the number of sub-fields during which a change rate of a voltage is small in a PDP according to the tenth embodiment of the present invention. Configurations of the PDP used in the plasma display device of the tenth embodiment are the same as those of the conventional one shown in FIGS. 17 and 18. In the tenth embodiment, a temperature sensor is also attached on a driving substrate in a rear of a panel so as to measure a panel temperature. The driving method of the tenth embodiment is the same as that in the eighth embodiment except that a width of a scanning pulse is changed according to an APL.

In the tenth embodiment, when the APL is the lower in particular, by using time obtained by shortening a width of a scanning pulse for extension of the wall charge adjusting period 10, as shown in FIG. 11, the number of sub-fields during which a change rate of a voltage is small at the same APL level can be increased more when compared with the case of the ninth embodiment shown in FIG. 10.

Thus, according to the method for driving the plasma display device of the tenth embodiment, since, when the ALP is lower, a width of a scanning pulse is shortened more, it is possible to increase the number of sub-fields during which a change rate of a voltage is small.

Eleventh Embodiment

Figure 12:
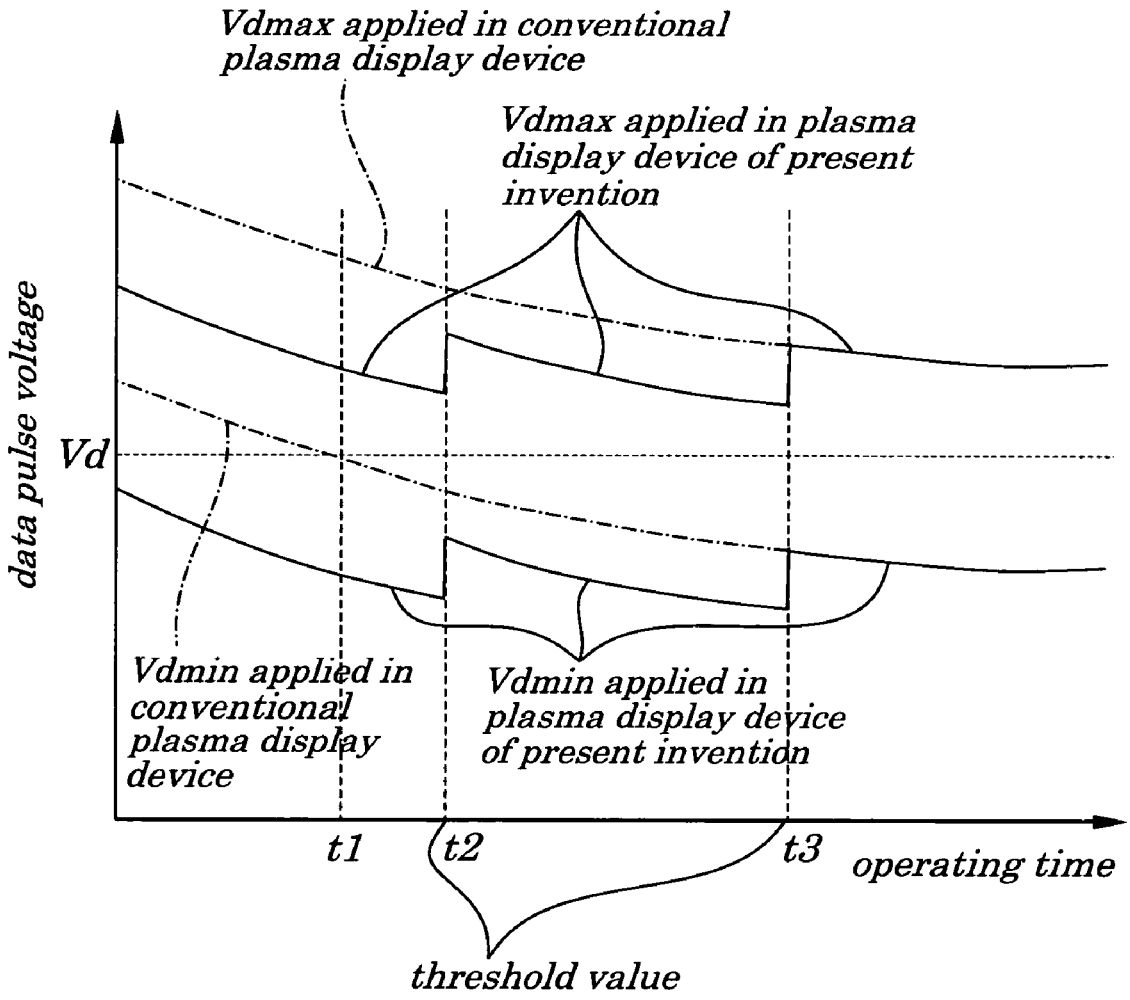
FIG. 12 is a diagram showing operating time dependence of minimum and maximum data pulse voltages required for normal operations of a PDP according to an eleventh embodiment of the present invention.
Figure 13:
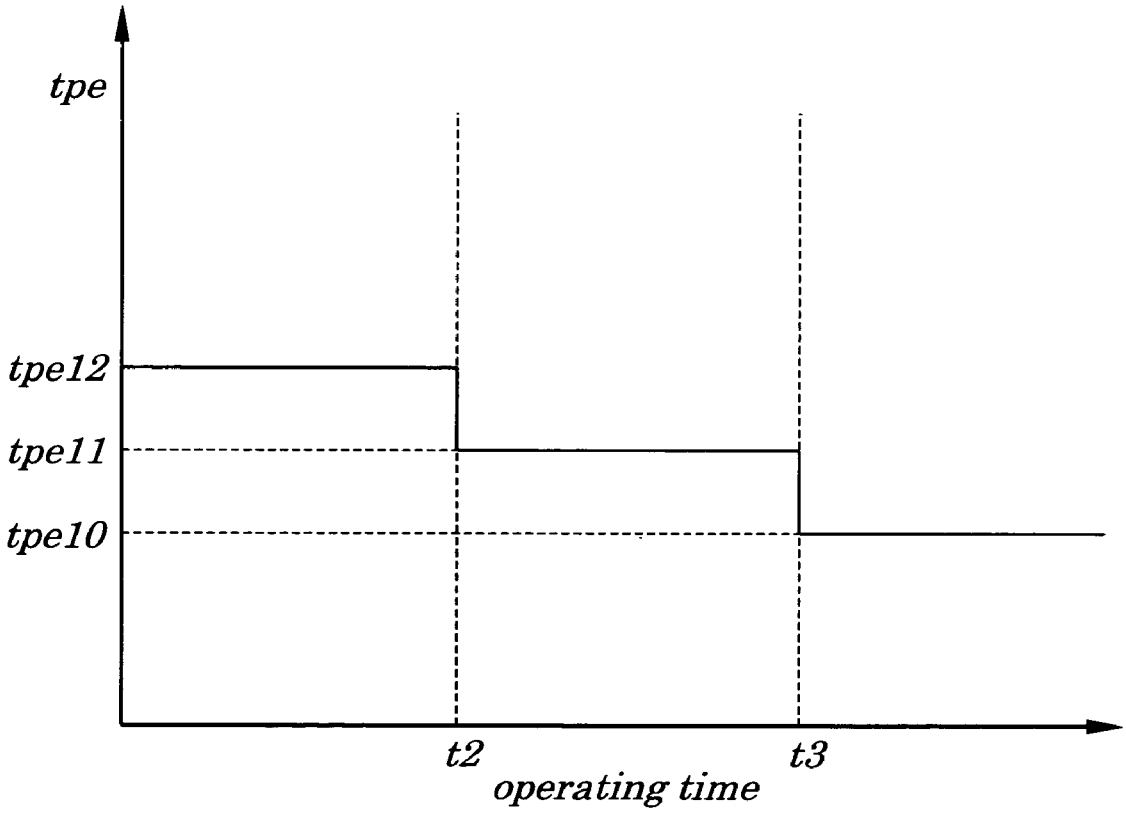
FIG. 13 is a diagram showing a relation between time during which a voltage changes in a wall charge adjusting period and operating time in the PDP of the eleventh embodiment of the present invention.

FIG. 12 is a diagram showing operating time dependence of minimum and maximum data pulse voltages required for normal operations of a PDP according to the eleventh embodiment of the present invention. FIG. 13 is a diagram showing a relation between time during which a voltage changes in a wall charge adjusting period and operating time in the PDP of the eleventh embodiment. Configurations of the PDP used in the plasma display device of the eleventh embodiment are the same as those of the conventional one shown in FIGS. 17 and 18. Moreover, in this embodiment, the operating time of the PDP denotes cumulative time during which display operations are performed after fabrication of the PDP module. In terms of technology, the cumulative time represents a sum of time during which each cell is actually turned ON. However, since variations in cumulative light-emitting time in each cell are thought to be not large, the operating time is actually defined as time during which a panel is used. For example, in the case of a display device of a television, since an actually displayed video has to be taken into consideration, about 30% out of the cumulative operating time of a panel is the time during which each cell is actually turned ON.

In the conventional PDP, in an initializing state in which total operating time is short, variations in an operating voltage are large, however, as the operating time wears on to some extent, operating voltages gradually become stable. For example, as shown by alternating dot/dashed lines in FIG. 12, in an initializing state, a data pulse voltage "Vdmin" required for occurrence of writing discharge and a voltage "Vdmax" being an upper limit value of the data pulse voltage "Vd" at which no erroneous discharge would occur are high and, therefore, if the operating time is shorter than "t1", a writing failure occurs, however, as the operating time wears on, these voltages converge at one fixed value which causes the driving to start at the set voltage "Vd".

To solve such the problem of the writing failure in the initializing state, in the eleventh embodiment, as shown in FIG. 13, a change rate of a voltage in the wall charge adjusting period 10 is changed according to total operating time. That is, in the initializing period, by strengthening time during which a potential difference between each of scanning electrodes 22 and each of data electrodes 29 changes, so as to be, for example, tpe12, to make small a change rate of a voltage and, as the operating time wears on, by shortening time during which the potential difference between each of the scanning electrodes 22 and each of the data electrodes 29 changes, step by step, so as to become, for example, tpe11 and tpe10, the change rate of the voltage is made large. By operating as above, as shown in FIG. 12, the data pulse voltage "Vdmin" occurring in the initializing state becomes lower than that employed in the conventional case and the data pulse voltage "Vdmax" occurring after operations for a long time is not made lower than that employed in the conventional case.

In FIG. 12, the PDP is shown which has a characteristic that, as operating time becomes longer, the operating voltage is lowered. However, some PDPs shows different characteristics that an operating voltage increases, as operating time elapses, depending on a structure of a panel, difference in materials for the panel, or a like, or that an operating voltage decreases until specified operating time elapses and thereafter the operating voltage increases. In the case of the PDP having such the characteristic as an operating voltage increases as operating time elapses, unlike in the case shown in FIG. 12, by making long the time "tpe" during which a voltage to be applied to each of the scanning electrodes 22 changes as operating time becomes long, a change rate of a voltage changes is made small. Also, in the case of the PDP having such the characteristic as an operating voltage decreases as operating time elapses and then starts to increase, by changing time "tpe" during which a voltage to be applied to each of the scanning electrodes 22 changes in a manner to satisfy the operating voltage characteristic, normal operations can be ordinarily achieved as the operating time elapses.

Thus, according to the method for driving the plasma display device of the eleventh embodiment, since time during which a potential difference between each of scanning electrodes and each of data electrodes 29 in the wall charge adjusting period 10 changes is switched as operating time of the PDP wears on, the data pulse voltage "Vdmin" occurring in an initializing state can be made not to become lower than that in the conventional case and the data pulse voltage "Vdmax" occurring after operations for a long time is made not to become lower than that in the conventional case.

Twelfth Embodiment

Figure 14:
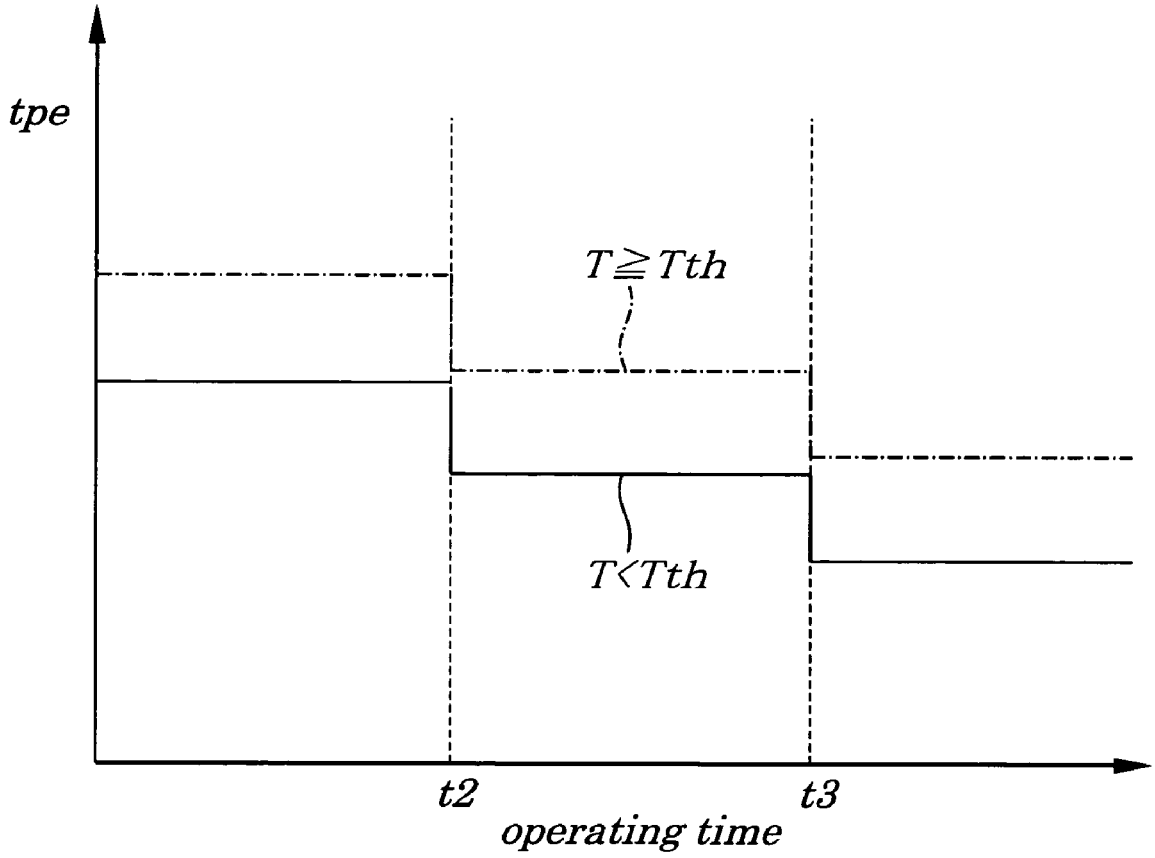
FIG. 14 is a diagram showing a relation between time during which a voltage changes in a wall charge adjusting period and operating time in a PDP of a twelfth embodiment of the present invention.

FIG. 14 is a diagram showing a relation between time during which a voltage changes in a wall charge adjusting period and operating time in a PDP of the twelfth embodiment of the present invention. Configurations of the PDP used in a plasma display device of the twelfth embodiment are the same as those of the conventional one shown in FIGS. 17 and 18. The definition of the operating time of the PDP is the same as that explained in the eleventh embodiment.

FIG. 14 shows a method for switching a time "tpe" during which a potential difference between each of scanning electrodes 22 and each of data electrodes 29 in the twelfth embodiment changes as operating time wears on.

Thus, as shown in FIG. 14, as in the eleventh embodiment, time "tpe" during which a potential difference between each of scanning electrodes 22 and each of data electrodes 29 changes is switched as operating time wears on in a wall charge adjusting time 10 and a length of the time "tpe" is switched also according to a panel temperature.

That is, when the panel temperature is higher or equal to a set temperature "Tth", by lengthening the above time "tpe" compared with the case when the panel temperature is lower than the set temperature, a change rate of a voltage during the wall charge adjusting period 10 is made small. By operating as above, it is possible to suppress a writing failure when the panel temperature is higher or equal to the set temperature.

Thus, according to the method for driving the plasma display device of the twelfth embodiment, since a change rate of a voltage between each of scanning electrodes 22 and each of data electrodes 29 is changed according to both operating time and panel temperature of the PDP during the wall charge adjusting period 10, it is possible to achieve stable writing in each operating time in a manner to correspond to the panel temperature.

Thirteenth Embodiment

Figure 15A:
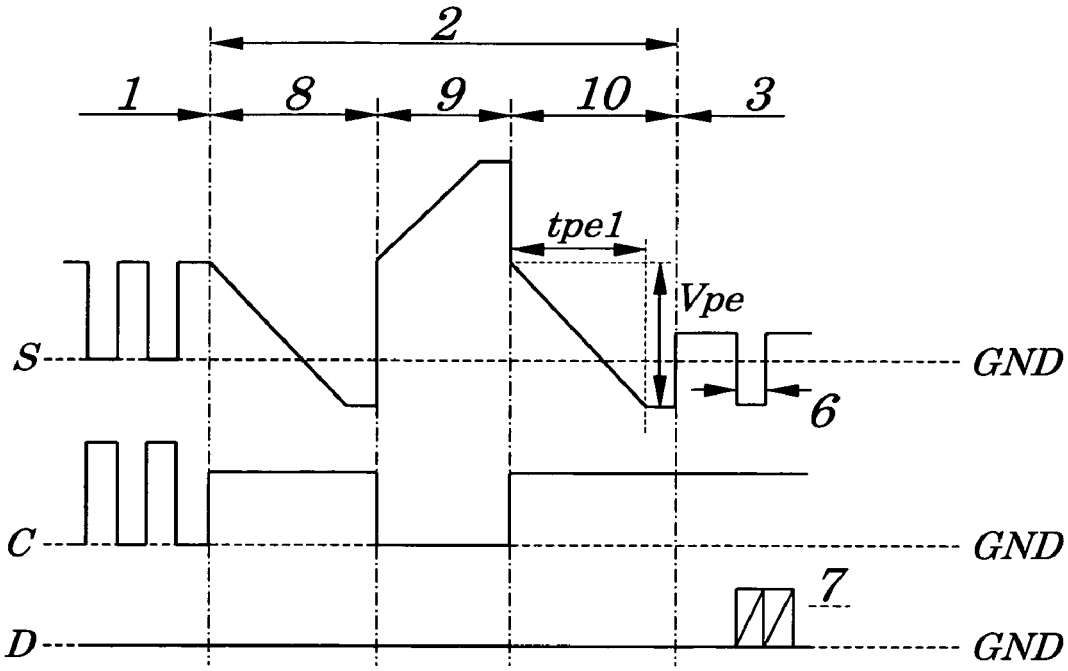
FIGS. 15A and 15B are diagrams showing driving waveforms of pulses applied immediately before, after, and during an initializing period in a PDP used in a plasma display device of a thirteenth embodiment of the present invention.
Figure 15B:
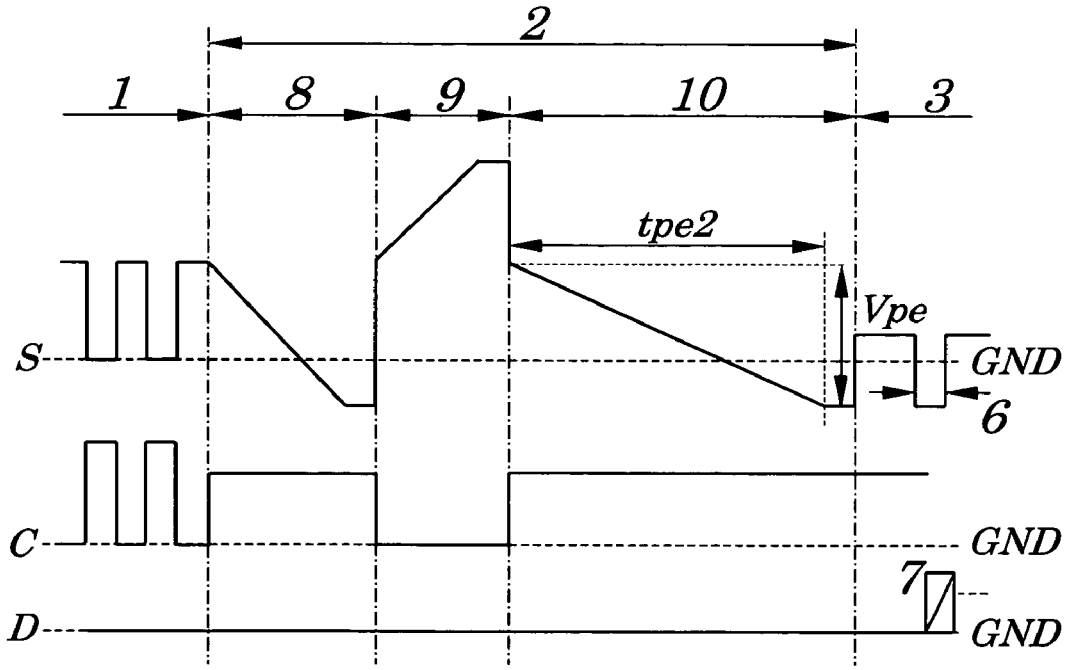
Figure 16:
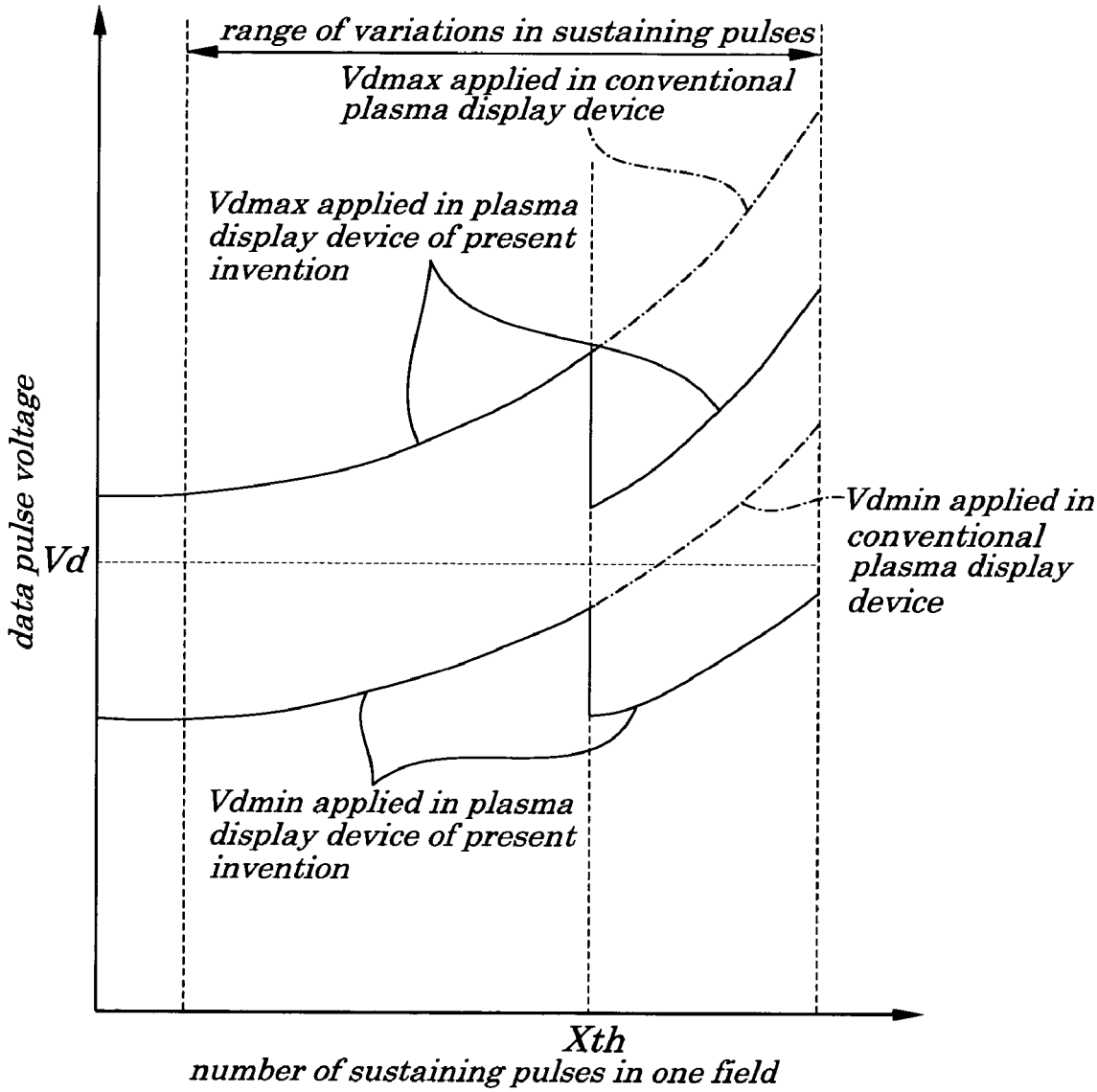
FIG. 16 is a diagram showing dependence on the number of sustaining pulses of maximum and minimum data pulse voltages for normal operations in the PDP of the thirteenth embodiment of the present invention.

FIGS. 15A and 15B are diagrams showing driving waveforms of pulses applied immediately before, after, and during an initializing period in a PDP used in a plasma display device of a thirteenth embodiment of the present invention. FIG. 16 is a diagram showing dependence on the number of sustaining pulses of maximum and minimum data pulse voltages for normal operations in the PDP of the thirteenth embodiment of the present invention. Configurations of the PDP used in the plasma display device of the thirteenth embodiment are the same as those of the conventional one shown in FIGS. 17 and 18.

In the method for driving the PDP, as shown in FIGS. 15A and 15B, a change rate of a voltage of each of scanning electrodes 22 and each of data electrodes 29 during a wall charge adjusting period 10 is made different between a case in which the total number of sustaining pulses in one field is larger than a preset number of sustaining pulses and a case in which the total number of sustaining pulses in one field is smaller than the preset number of sustaining pulses. Specifically, when the number of sustaining pulses is smaller than a preset number of sustaining pulses "Xth" (see FIG. 15A), a change rate of a voltage between each of scanning electrodes 22 and each of data electrodes 29 is made large and, when the number of sustaining pulses is larger or equal to the preset number of sustaining pulses "Xth" (see FIG. 15B), the change rate of the voltage between each of scanning electrodes 22 and each of data electrodes 29 is made small.

Generally, the total number of sustaining pulses in one field is changed according to an APL, as described in the ninth embodiment. In the case of white display, for example, if the APL is at a low level and the number of sustaining pulses becomes large, a state within a discharge cell is activated and an amount of discharge in a wall charge adjusting period 10 is made large and an amount of wall charges between each of scanning electrodes and each of data electrodes decreases more, thus causing an increase in voltage "Vdmin" required for occurrence of writing discharge, as shown by alternating dot/dashed lines. On the other hand, due to the same reasons, an upper limit voltage "Vdmax" being a data pulse voltage at which writing discharge does not occur between each of scanning electrodes 22 and each of data electrodes 29 is also increased as shown by alternating dot/dashed lines in FIG. 16.

In the thirteenth embodiment, a change rate of a voltage between each of scanning electrodes 22 and each of data electrodes 29 is changed by using the preset number of sustaining pulses Xth in one field as a threshold value. By operating as above, when the number of sustaining pulses is larger than the preset number of sustaining pulses, an amount of wall charges formed between each of scanning electrodes 22 and each of data electrodes 29 can be made large compared with the conventional case. As a result, if the number of sustaining pulses in one field is larger than the preset number of sustaining pulses "Xth", it is possible to decrease both the minimum data pulse voltage "Vdmin" required for occurrence of writing discharge and the upper limit value "Vdmax" being a data pulse voltage at which no writing discharge occurs, which enables the PDP to be driven at a set data pulse voltage "Vd" within a range of variations in the number of sustaining pulses.

Thus, according to the plasma display device of the thirteenth embodiment, by changing a change rate of a voltage between each of scanning electrodes 22 and each of data electrodes 29, when the number of sustaining pulses in one field is larger than the preset number of sustaining pulses "Xth", a change rate of the voltage between each of scanning electrodes 22 and each of data electrodes 29 is made small to increase an amount of wall charges between each of the scanning electrodes 22 and each of the data electrodes 29 and to lower both the minimum data pulse voltage "Vdmin" required for occurrence of writing discharge and the upper voltage value "Vdmax" being a data pulse voltage at which no writing discharge occurs, thus enabling the PDP to be driven at the set data pulse voltage within a range of variations in the number of sustaining pulses.

It is apparent that the present invention is not limited to the above embodiments but may be changed and modified without departing from the scope and spirit of the invention. For example, in each of the above embodiments, the initializing period 2 includes both the sustaining erasing period 8 and priming period 9, however, the sustaining erasing period 8 and priming period 9 may be omitted and the initialization can be realized by using only the wall charge adjusting period 10.

What is claimed is:

1. A method for driving a plasma display device comprising a panel which comprises a first substrate on which two or more pairs of electrodes are formed, each pair being made up of a scanning electrode and a sustaining electrode, both being parallel to each other and a second substrate on which two or more data electrodes are formed in a manner in which each of said data electrodes and each pair of electrodes intersect each other, said method comprising:

a step of controlling display operations in a scanning period during which a scanning pulse is sequentially applied to said scanning electrode to cause writing discharge to occur according to a video signal in each of sub-fields obtained by dividing one field displaying one video signal into two or more sub-fields, in a sustaining period during which a cell having undergone said writing discharge is turned ON in each of said sub-fields, and in an initializing period being set before said scanning period during which wall charges and space charges accumulated in said cell before said scanning period starts are initialized in each of said sub-fields; and a step of changing, in at least one sub-field out of said two or more sub-fields making up said one field, a change rate of a potential difference between said scanning electrode and said data electrode according to a panel temperature and/or cumulative operating time of said panel during a wall charge adjusting period existing in a final portion of said initializing period, during which said potential difference between said scanning electrode and said data electrode changes gradually.

2. The method for driving the plasma display device according to claim 1, wherein a sub-field having said wall charge adjusting period during which a change rate of a potential difference between said scanning electrode and said data electrode is changed is so configure to exist on a side of a sub-field during which a number of sustaining pulses to be applied in said sustaining period is larger.

3. The method for driving the plasma display device according to claim 1, wherein the number of sub-fields during which a change rate of a potential difference between said scanning electrode and said data electrode in said wall charge adjusting period is changed is changed according to the number of sustaining pulses in said one field.

4. The method for driving the plasma display device according to claim 3, wherein, when the number of sustaining pulses in said one field is the larger, the number of sub-fields during which a change rate of a potential difference between said scanning electrode and said data electrode in said wall charge adjusting period is changed is made the smaller.

5. The method for driving the plasma display device according to claim 1, wherein a pulse width of said scanning pulse is changed according to the number of sub-fields during which a change rate of a potential difference between said scanning electrode and said data electrode in said wall charge adjusting period is changed.

6. The method for driving the plasma display device according to claim 5, wherein, when the number of sub-fields during which a change rate of a potential difference between said scanning electrode and said data electrode in said wall charge adjusting period is changed is the larger, said pulse width of said scanning pulse is made the smaller.

7. The method for driving the plasma display device according to claim 1, wherein, the higher said panel temperature is, the more a change rate of a potential difference between said scanning electrode and said data electrode in said wall charge adjusting period decreases.

8. The method for driving the plasma display device according to claim 1, wherein, the longer cumulative operating time of said panel is, a change rate of a potential difference between said scanning electrode and said data electrode in said wall charge adjusting period is made the larger.

9. The method for driving the plasma display device according to claim 1, wherein, irrespective of variations in a change rate of a potential difference between said scanning electrode and said data electrode in said wall charge adjusting period, a final ultimate potential difference between said scanning electrode and said data electrode in said wall charge adjusting period is not changed.

10. The method for driving the plasma display device according to claim 1, wherein a length of said wall charge adjusting period is changed according to a change rate of a potential difference between said scanning electrode and said data electrode in said wall charge adjusting period.

11. The method for driving the plasma display device according to claim 1, wherein, after a period during which a potential difference between said scanning electrode and said data electrode changes, a holding period during which said potential difference becomes constant is set and wherein, irrespective of variations in a change rate of a potential difference between said scanning electrode and said data electrode in said wall charge adjusting period, said holding period is not changed.

12. The method for driving the plasma display device according to claim 1, wherein, according to the number of sustaining pulses in said sustaining period, a change rate of a potential difference between said scanning electrode and said data electrode in said wall charge adjusting period is changed.

13. The method for driving the plasma display device according to claim 1, wherein a change rate of a potential difference between said scanning electrode and said data electrode in said wall charge adjusting period is changed according to at least one threshold value in said temperature and/or cumulative operating time of said panel so that said change rate of said potential difference becomes a predetermined change rate.

14. The method for driving the plasma display device according to claim 1, wherein a pulse width of said scanning pulse is changed according to a change rate of a potential difference between said scanning electrode and said data electrode in said wall charge adjusting period.

15. The method for driving the plasma display device according to claim 14, wherein, when a change rate of a potential difference between said scanning electrode and said data electrode in said wall charge adjusting period is the smaller, said pulse width of said scanning pulse is made the smaller.

16. The method for driving the plasma display device according to claim 2, wherein the number of sub-fields during which a change rate of a potential difference between said scanning electrode and said data electrode in said wall charge adjusting period is changed is changed according to the number of sustaining pulses in said one field.

17. The method for driving the plasma display device according to claim 16, wherein, when the number of sustaining pulses in said one field is the larger, the number of sub-fields during which a change rate of a potential difference between said scanning electrode and said data electrode in said wall charge adjusting period is changed is made the smaller.

18. The method for driving the plasma display device according to claim 2, wherein a pulse width of said scanning pulse is changed according to the number of sub-fields during which a change rate of a potential difference between said scanning electrode and said data electrode in said wall charge adjusting period is changed.

19. The method for driving the plasma display device according to claim 18, wherein, when the number of sub-fields during which a change rate of a potential difference between said scanning electrode and aid data electrode in said wall charge adjusting period is changed is the larger, said pulse width of said scanning pulse is made the smaller.

20. A plasma display device comprising a panel which comprises:

a first substrate on which two or more pairs of electrodes are formed, each pair being made up of a scanning electrode and a sustaining electrode, both being parallel to each other; and a second substrate on which two or more data electrodes are formed in a manner in which each of said data electrodes and each pair of electrodes intersect each other;

wherein display operations are controlled in a scanning period during which a writing discharge is made to occur according to video signals, in a sustaining period during which a cell having undergone said writing discharge is turned ON, and in an initializing period being set before said scanning period, during which wall charges and space charges accumulated in said cell before said scanning period starts are initialized; and wherein said initializing period has, in its final portion, a wall charge adjusting period during which a potential difference between said scanning electrode and said data electrode changes gradually and a change rate of said potential difference is controlled according to a panel temperature and/or cumulative operating time of said panel.

21. A plasma display device comprising a panel which comprises a first substrate on which two or more pairs of electrodes are formed, each pair being made up of a scanning electrode and a sustaining electrode, both being parallel to each other; and a second substrate on which two or more data electrodes are formed in a manner in which each of said data electrodes and each pair of electrodes intersect each other;

wherein display operations are controlled in a scanning period during which a writing discharge is made to occur according to video signals, in a sustaining period during which a cell having undergone said writing discharge is turned ON, and in an initializing period being set before said scanning period, during which wall charges and space charges accumulated in said cell before said scanning period starts are initialized, in each of two or more sub-fields obtained by dividing one field, each of which comprises said scanning period, said sustaining period and said initializing period; and wherein, in at least one sub-field out of said two or more sub-fields making up one field, said initializing period has, in its final portion, a wall charge adjusting period during which a potential difference between said scanning electrode and said data electrode changes gradually and a change rate of said potential difference is controlled according to a panel temperature and/or cumulative operating time of said panel.

22. The plasma display device according to claim 21, wherein said sub-field during which a change rate of said potential difference is controlled according to said panel temperature and/or cumulative operating time of said panel is a sub-field, during which the largest number of sustaining pulses exists, out of said two or more sub-fields making up one field, or N ("N" denotes an integer being smaller than the number of sub-fields in one field)-pieces of sub-fields being set in decreasing order of number of sustaining pulses.

23. A method for driving a plasma display device comprising a panel which comprises a first substrate on which two or more pairs of electrodes are formed, each pair being made up of a scanning electrode and a sustaining electrode, both being parallel to each other and a second substrate on which two or more data electrodes are formed in a manner in which each of said data electrodes and each pair of electrodes intersect each other, said method comprising:

a step of controlling display operations in a scanning period during which a scanning pulse is sequentially applied to said scanning electrode to cause writing discharge to occur according to video signals, in a sustaining period during which a cell having undergone said writing discharge is turned ON, and in an initializing period being set before said scanning period, during which wall charges and space charges accumulated in said cell before said scanning period starts are initialized; and a step of changing a change rate of a potential difference between said scanning electrode and said data electrode according to a panel temperature and/or cumulative operating time of said panel during a wall charge adjusting period existing in a final portion of said initializing period during which said potential difference between said scanning electrode and said data electrode changes gradually.

24. The method for driving the plasma display device according to claim 23, wherein, the higher said panel temperature is, the more a change rate of a potential difference between said scanning electrode and said data electrode in said wall charge adjusting period decreases.

25. The method for driving the plasma display device according to claim 23, wherein, the longer cumulative operating time of said panel is, a change rate of a potential difference between said scanning electrode and said data electrode in said wall charge adjusting period is made the larger.

26. The method for driving the plasma display device according to claim 23, wherein, irrespective of variations in a change rate of a potential difference between said scanning electrode and said data electrode in said wall charge adjusting period, a final ultimate potential difference between said scanning electrode and said data electrode in said wall charge adjusting period is not changed.

27. The method for driving the plasma display device according to claim 23, wherein a length of said wall charge adjusting period is changed according to a change rate of a potential difference between said scanning electrode and said data electrode in said wall charge adjusting period.

28. The method for driving the plasma display device according to claim 23, wherein, after a period during which a potential difference between said scanning electrode and said data electrode changes, a holding period during which said potential difference becomes constant is set and wherein, irrespective of variations in a change rate of a potential difference between said scanning electrode and said data electrode in said wall charge adjusting period, said holding period is not changed.

29. The method for driving the plasma display device according to claim 23, wherein, according to the number of sustaining pulses in said sustaining period, a change rate of a potential difference between said scanning electrode and said data electrode in said wall charge adjusting period is changed.

30. The method for driving the plasma display device according to claim 23, wherein a change rate of a potential difference between said scanning electrode and said data electrode in said wall charge adjusting period is changed according to at least one threshold value in said temperature and/or cumulative operating time of said panel so that said change rate of said potential difference becomes a predetermined change rate.

31. The method for driving the plasma display device according to claim 23, wherein a pulse width of said scanning pulse is changed according to a change rate of a potential difference between said scanning electrode and said data electrode in said wall charge adjusting period.

32. The method for driving the plasma display device according to claim 31, wherein, when a change rate of a potential difference between said scanning electrode and said data electrode in said wall charge adjusting period is the smaller, said pulse width of said scanning pulse is made the smaller.

* * * * *